US010427437B2

(12) United States Patent
Arakane et al.

(10) Patent No.: US 10,427,437 B2
(45) Date of Patent: Oct. 1, 2019

(54) INK-JET PRINTER

(71) Applicant: BROTHER KOGYO KABUSHIKI KAISHA, Nagoya-shi, Aichi-ken (JP)

(72) Inventors: Satoru Arakane, Nagoya (JP); Kenji Kawamoto, Nagoya (JP)

(73) Assignee: BROTHER KOGYO KABUSHIKI KAISHA, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/926,267

(22) Filed: Mar. 20, 2018

(65) Prior Publication Data

US 2018/0272769 A1 Sep. 27, 2018

(30) Foreign Application Priority Data

Mar. 27, 2017 (JP) ..... 2017-061134
Nov. 2, 2017 (JP) ..... 2017-212537

(51) Int. Cl.

| | |
|---|---|
| ***B41J 11/00*** | (2006.01) |
| ***B41J 29/42*** | (2006.01) |
| ***B41J 19/20*** | (2006.01) |
| ***B41J 29/38*** | (2006.01) |

(52) U.S. Cl.

CPC ..... *B41J 29/42* (2013.01); *B41J 11/008* (2013.01); *B41J 11/0095* (2013.01); *B41J 19/207* (2013.01); *B41J 29/38* (2013.01)

(58) Field of Classification Search

CPC ..... B41J 11/008; B41J 11/0095; B41J 29/42
See application file for complete search history.

(56) References Cited

U.S. PATENT DOCUMENTS

2012/0026217 A1* 2/2012 Anzai ..... B41J 19/202 347/5

FOREIGN PATENT DOCUMENTS

| | | |
|---|---|---|
| JP | 2010-184443 A | 8/2010 |
| JP | 2016-137674 A | 8/2016 |

* cited by examiner

*Primary Examiner* — Kristal Feggins
*Assistant Examiner* — Kendrick X Liu
(74) *Attorney, Agent, or Firm* — Scully, Scott, Murphy & Presser, P.C.

(57) ABSTRACT

There is provided an ink-jet printer which includes a head, a carriage, an encoder having a scale and a sensor, a memory, and a controller. The controller executes judging whether or not a recording medium is positioned at an area that can face the carriage, and detecting an abnormal position, and printing an image on a recording medium, and comparing a velocity parameter value acquired and a first threshold value, when the carriage is at a position other than the abnormal position, and comparing the velocity parameter value acquired and a second threshold value corresponding to a velocity slower than the first threshold value, when the carriage is at the abnormal position.

19 Claims, 16 Drawing Sheets

Fig. 5B

| | POSITION OTHER THAN ABNORMAL POSITION | ABNORMAL POSITION |
|---|---|---|
| PAPER RUBBING | THIRD THRESHOLD VALUE ≤ CARRIAGE VELOCITY < FIRST THRESHOLD VALUE | THIRD THRESHOLD VALUE ≤ CARRIAGE VELOCITY < SECOND THRESHOLD VALUE |
| JAMMING | CARRIAGE VELOCITY < THIRD THRESHOLD VALUE | CARRIAGE VELOCITY < THIRD THRESHOLD VALUE |

FIRST THRESHOLD VALUE > SECOND THRESHOLD VALUE

CARRIAGE VELOCITY ACQUIRED
DROPPING DUE TO PAPER RUBBING

CARRIAGE VELOCITY ACQUIRED
DROPPING DUE TO JAMMING

INK-JET PRINTER

CROSS REFERENCE TO RELATED APPLICATION

The present application claims priorities from Japanese Patent Applications No. 2017-061134 filed on Mar. 27, 2017 and No. 2017-212537 filed on Nov. 2, 2017, the disclosures of which are incorporated herein by reference in its entirety.

BACKGROUND

Field of the Invention

The present invention relates to an ink-jet printer.

Description of the Related Art

As an example of an ink-jet printer, there is known an ink-jet printer of serial type in which an ink is jetted from a head while moving a carriage on which the head is mounted in a scanning direction. In the heretofore known ink-jet printer, a drive motor is controlled with a feedback control such that a current value corresponding to a deviation between a velocity of the carriage detected by a linear encoder and a target velocity of the carriage is applied to the drive motor of the carriage.

Incidentally, due to a so-called cockling in which a paper form a waveform by absorbing an ink jetted from a head, and a deformation of the paper such as curling due to absorbing the ink, sometimes there is a rubbing or friction between the paper and the head during the movement of the carriage. When such rubbing occurs, there is a possibility of a damage of the head and jamming of paper.

In the feedback control of the drive motor of the carriage, it has been known that when the velocity of the carriage becomes slower than the target velocity due to the rubbing, the current value applied to the drive motor becomes higher than the normal. Therefore, in the heretofore ink-jet printer, by using this phenomenon, in a case in which the current value has surpassed a predetermined threshold value, a judgment that the rubbing occurs is made.

SUMMARY

Here, the linear encoder which detects the velocity of the carriage is generally provided along a scanning direction. The linear encoder has a scale on which indicators or marks are formed at a predetermined interval, and a detecting section for detecting the indicators formed on the scale, which is mounted on the carriage. Moreover, the linear encoder, during the movement of the carriage, detects the velocity of the carriage by reading the indicator on the scale. In such linear encoder, when a defect or an abnormality such as accumulation of dirt on the scale or a damage of the scale occurs, it becomes hard for the detecting section to read the indicator on the scale accurately. As a result of this, the velocity of the carriage detected by the linear encoder may become slower than the practical velocity. In this case, in the heretofore known ink-jet printer, when the velocity of the carriage detected by the linear encoder becomes slower than the target velocity due to the dirt on the scale, regardless of the rubbing not occurring practically, there is a possibility of making a judgment erroneously that the rubbing occurs.

An object of the present teaching is to provide an ink-jet printer in which it is possible to make an accurate judgment of rubbing between the head and the recording medium.

According to an aspect of the present teaching, there is provided an ink-jet printer including: a carriage configured to move in a scanning direction; a head including a nozzle, the head mounted on the carriage; and an encoder. The encoder includes: a scale extending in the scanning direction and including a plurality of indicators formed at a predetermined interval in the scanning direction; and a sensor mounted on the carriage, the sensor being configured to detect the indicators formed on the scale. The printer further includes: a memory; and a controller. The controller is configured to perform: judging whether a recording medium is positioned at a facing area being capable of facing the carriage; detecting an abnormal position on the scale in the scanning direction, under a condition that the controller judges that the recording medium is not positioned at the facing area, wherein detecting the abnormal position includes: moving the carriage in the scanning direction; generating abnormal-position information indicating the abnormal position on the scale, based on a result of detecting the indicators by the sensor during a movement of the carriage; and storing the abnormal-position information in the memory; printing an image on the recording medium, under a condition that the controller judges that the recording medium is positioned at the facing area, wherein printing the image includes: controlling a velocity of the carriage based on a velocity parameter value of the carriage acquired from the result of detecting the indicators by the sensor, such that the carriage moves in the scanning direction at a target velocity; and controlling the head to discharge a liquid from the nozzle toward the recording medium based on image data; under a condition that the controller performs printing the image and that a detection position on the scale detected by the sensor is not same as the abnormal position in the abnormal-position information stored in the memory, comparing a velocity parameter value acquired when the sensor detects the detection position on the scale and a first threshold value corresponding to a velocity lower than the target velocity at the time of printing the image; and under a condition that the controller performs printing the image and that a detection position on the scale detected by the sensor is same as the abnormal position in the abnormal-position information stored in the memory, comparing a velocity parameter value acquired when the sensor detects the detection position on the scale and a second threshold value corresponding to a velocity lower than the first threshold value.

According to the present teaching, in a case in which the detection position is an abnormal position, it is possible to make a judgment that rubbing occurs between the head and the recording medium, by using the second threshold value corresponding to the velocity slower than the first threshold value which is to be used in a case in which the detection position is a position other than the abnormal position. In such manner, by using a threshold value that differs for the abnormal position and a position other than the abnormal position on the scale, even when the velocity parameter value acquired on the basis of the result of detecting the indicator by the detecting section is lower due to a defect on the scale, it is possible to judge accurately the rubbing that occurs between the head and the recording medium.

BRIEF DESCRIPTION OF THE DRAWINGS

FIG. 5B is a diagram describing a threshold value according to a paper rubbing and jamming at an abnormal position and a position other than the abnormal position;

FIG. 6A is a diagram when rubbing of paper is the factor that lowers the carriage velocity, and FIG. 6B is a diagram when jamming of paper is the factor that lowers the carriage velocity;

FIG. 7A is a diagram when a dirt on the scale is the factor that lowers the carriage velocity, and FIG. 7B is a diagram when rubbing of paper and dirt on the scale are factors that lower the carriage velocity;

DETAILED DESCRIPTION OF THE EMBODIMENTS

Figure 1:
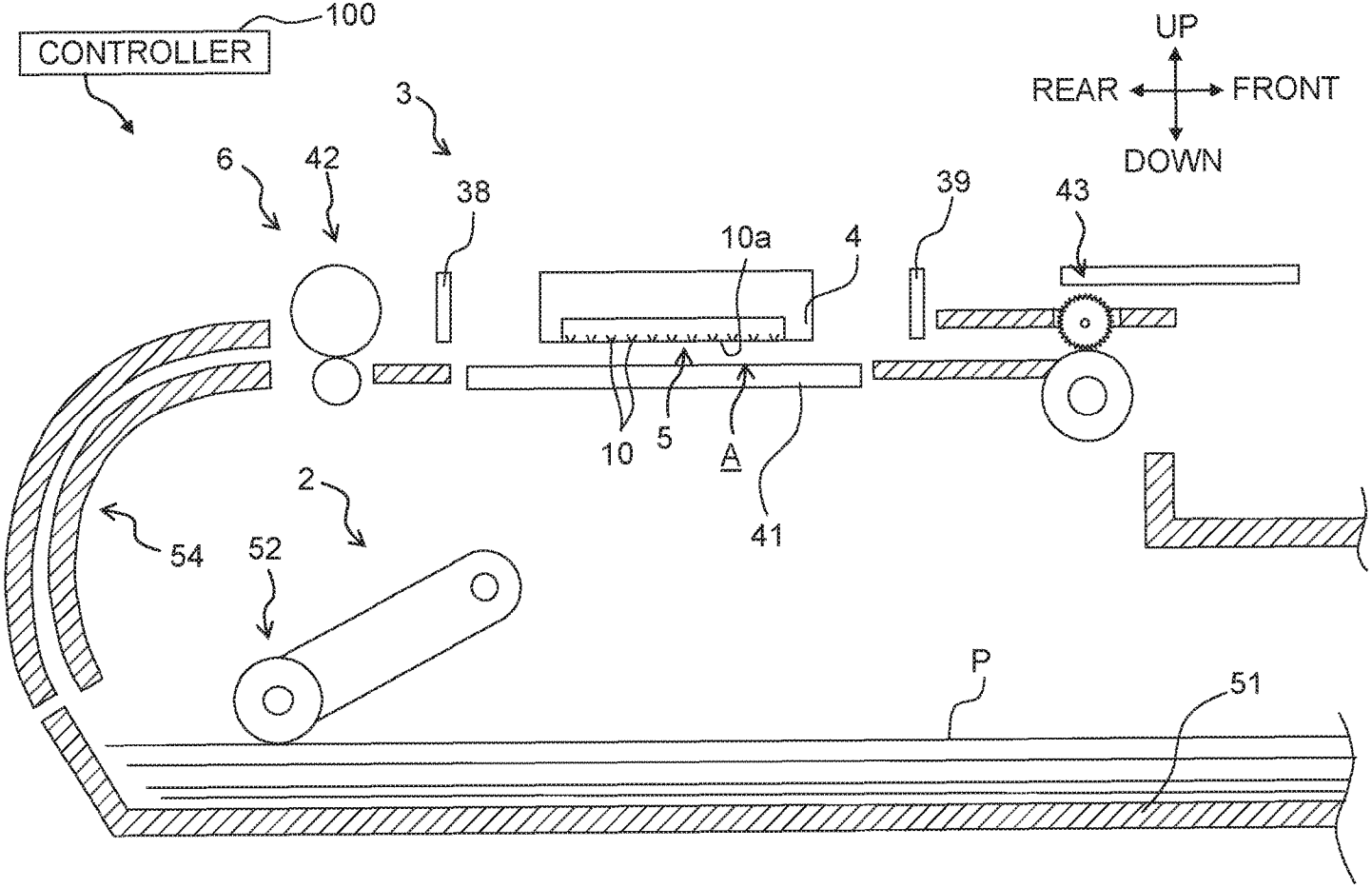
FIG. 1 is a schematic vertical cross-sectional view of an ink-jet printer.
Figure 2:
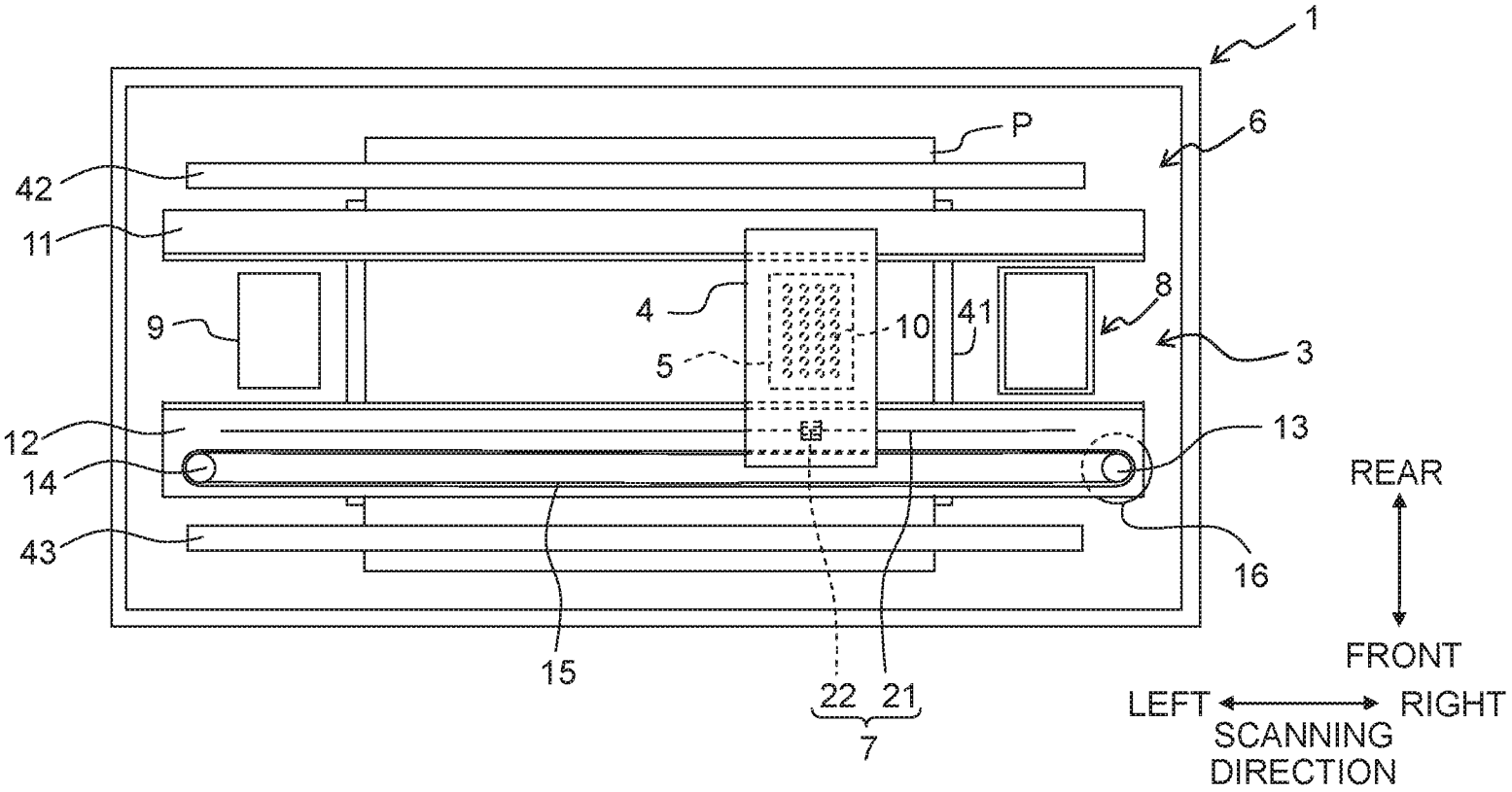
FIG. 2 is a schematic plan view of the ink-jet printer.

The description will be made below by citing an ink-jet printer 1 as an example of a printer. Moreover, the description below is made by stipulating a front-rear direction, a left-right direction, and a vertical direction that are mutually orthogonal as depicted in FIG. 1 and FIG. 2. As depicted in FIG. 1, the printer 1 includes a feeding unit 2, a printer unit 3, and a controller 100.

The feeding unit 2 includes a paper feeding tray 51 on which a paper P which is a recording medium is to be placed, and a pickup roller 52 which is provided at an upper side of the paper feeding tray 51. As a paper feeding motor 53 (refer to FIG. 5A) is driven under a control by the controller 100, the pickup roller 52 draws the papers P one-by-one from the paper feeding tray 51. The paper P drawn by the pickup roller 52 is fed along a guide 54, and is supplied to the printer unit 3.

The printer unit 3, as depicted in FIG. 2, includes a carriage 4, an ink-jet head 5 (hereinafter, referred to as 'head 5'), a conveyance mechanism 6, an encoder 7, a cap 8, and a flushing receiver 9. The carriage 4 is supported by two guide rails 11 and 12 extended in the left-right direction. The two guide rails 11 and 2 are arranged leaving a space mutually in the front-rear direction. Pulleys 13 and 14 are provided to two end portions respectively in the left-right direction, on an upper surface of the guide rail 12. A belt 15 which is an endless belt made of a rubber material is put around the pulleys 13 and 14. The carriage 4 is installed on a portion of the belt 15 positioned between the pulley 13 and the pulley 14. Moreover, a carriage motor 16 is connected to the pulley 13 on a right side. As the carriage motor 16 is made to undergo normal rotation and reverse rotation, the belt 15 runs by the rotation of the pulleys 13 and 14, and the carriage 4 undergoes reciprocating motion with the left-right direction as a scanning direction. At this time, the pulley 14 on a left side rotates with the running of the belt 15.

The head 5 is mounted on the carriage 4 and undergoes a reciprocating movement in the scanning direction together with the carriage 4. A lower surface of the head 5 is a nozzle surface 10*a* (refer to FIG. 1) in which a plurality of nozzles 10 for jetting an ink is formed. Moreover, an ink channel which communicates with the plurality of nozzles 10 is formed in the head 5, and an actuator which includes a plurality of drive elements that make the ink jet from each of the plurality of nozzles 10 by applying a pressure to the ink in the ink channel. The actuator is not restricted to an actuator of a specific type, and it is possible to use a piezoelectric actuator, as a drive element, which includes a piezoelectric element configured to apply a pressure to the ink by using a deformation by an inverse piezoelectric effect of a piezoelectric layer. As the drive element, it is possible to use a heater element for generating air bubbles in the ink by heat.

Moreover, the head 5 has three types (large droplets, medium droplets, and small droplets) of amount of ink that can be jetted from the nozzle 10 in one jetting cycle. Furthermore, the amount of ink to be jetted may be zero (no jetting). Accordingly, a density that can be expressed by dots formed on the paper P is a density in three stages corresponding to the amount of ink jetted. In such manner, in the printer 1, it is possible to carry out printing of three gradations on the paper P. The jetting cycle (period) is a time required for the head 5 to move by a unit distance corresponding to a resolution in the scanning direction.

The conveyance mechanism 6 includes a platen 41, and two conveyance rollers 42 and 43. The platen 41 is arranged at a lower side of the carriage 4, and at a position facing the carriage 4. A width in the left-right direction of the platen 41 is longer than a width in the left-right direction of the paper P, and the platen 41 supports the paper P from a lower side at the time of printing.

The two conveyance rollers 42 and 43 are arranged at front and rear to sandwich the platen 41. The two conveyance rollers 42 and 43 are driven to be rotated in synchronization by a conveyance motor 37 (refer to FIG. 5A) under the control of the controller 100, and convey the paper P fed from the feeding unit 2 to an area A (refer to FIG. 1, hereinafter, facing area A) facing the carriage 4, above the platen 41. A rotary encoder 40 (refer to FIG. 5A) which outputs a pulse signal corresponding to rotation of the conveyance roller 42, is installed on a rotating shaft of the conveyance roller 42. The controller 100 controls the transporting of the paper P on the basis of the pulse signal of the rotary encoder 40.

Moreover, as depicted in FIG. 1, a paper sensor 38 is arranged at an upstream side in the conveyance direction, of the conveyance rollers 42 and 43. The paper sensor 38 detects whether or not the paper P exists at a detection position. The detection position is located at an upstream side in the conveyance direction of the conveyance rollers 42 and 43, of the paper P in the conveyance path. The controller 100 makes a judgment of whether or not the paper P is positioned at the facing area, on the basis of a result of detection by the paper sensor 38 and a content of control with respect the conveyance motor 37. Specifically, the controller 100 determines a first time-point at which a front end of the paper P has reached the facing area A. The first time-point is a point of time at which an amount of the paper P conveyed by the conveyance rollers 42 and 43 on the basis of the pulse signal of the rotary encoder 40 has become an amount same as a distance between the detection position of the paper sensor 38 and the facing area A. Moreover, the controller 100 determines a second time-point at which a rear end of the paper P has got out from the facing area A. The second time-point is a point of time at which an amount of the paper P conveyed by the conveyance rollers 42 and 43 on the basis of the pulse signal of the rotary encoder 40 has become a total amount of a length of the facing area A (carriage 4) in the conveyance direction and a length of the paper P in the conveyance direction. Moreover, the controller 100 makes a judgment that the paper P is positioned in the facing area A during a time from the first time-point up to the second time-point.

Moreover, a paper sensor 39 is arranged at a downstream side in the conveyance direction of the conveyance rollers 42 and 43. The paper sensor 39 detects whether or not the paper P exists at a detection position. The detection position is located at a downstream side in the conveyance direction of the conveyance rollers 42 and 43, of the paper P in the conveyance path. The controller 100 makes a judgment of jamming of the paper P on the basis of the pulse signal from the rotary encoder 40 and a result of detection by the paper sensors 38 and 39. Specifically, the controller 100 makes a judgment that the jamming has occurred, when the paper sensor 39 has not detected the paper P, in spite of the number of pulses of the pulse signal from the rotary encoder 40 counted from a point of time at which the paper sensor 38 detected the paper P, having reached a value equivalent to a transportation distance between the paper sensors 38 and 39.

Figure 3A:
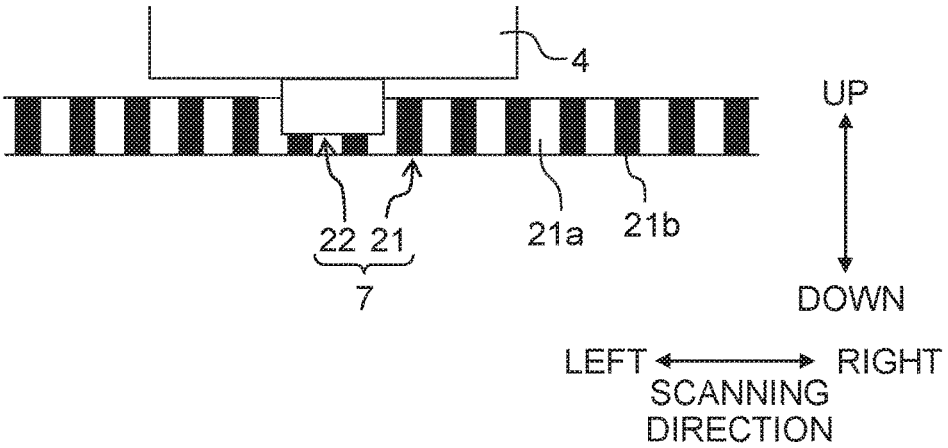
FIG. 3A is a diagram depicting an arrangement of a detection sensor and a scale of an encoder.

The encoder 7 is a linear encoder of transmission type, and has a scale 21 and a detection sensor 22 as depicted in FIG. 2 and FIG. 3. The scale 21 is arranged on the upper surface of the guide rail 12, and is extended in the scanning direction over a movable range of the carriage 4. Moreover, on the scale 21, a transmissive area 21*a* and a non-transmissive area 21*b* are arranged alternately in plurality along the scanning direction as depicted in FIG. 3A. A width in the scanning direction of each of the transmissive area 21*a* is same for all the transmissive areas 21*a*, and a width in the scanning direction of each of the non-transmissive area 21*b* is also same for all the non-transmissive areas 21*b*. In other words, on the scale 21, the plurality of transmissive areas 21*a* is formed at a predetermined interval (width of the non-transmissive area 21*b*) along the scanning direction and the plurality of non-transmissive areas 21*b* is formed at a predetermined interval (width of the transmissive area 21*a*) along the scanning direction. Moreover, the transmissive area 21*a* is an area that allows light to pass through while the non-transmissive area 21*b* is an area through which light does not pass.

The detection sensor 22 is mounted on the carriage 4, and includes a light-emitting element 26 and a light-receiving element 27. The light-emitting element 26 and the light-receiving element 27 are arranged to be sandwiching the scale 21 in the front-rear direction. The light-emitting element 26 irradiates light toward the light-receiving element 27. The light-receiving element 27 receives light irradiated from the light-emitting element 26. Moreover, the detection sensor 22 detects the transmissive area 21*a* and the non-transmissive area 21*b* letting a position on the scale 21 sandwiched between the light-emitting element 26 and the light-receiving element 27 to be the detection position.

Figure 3B:
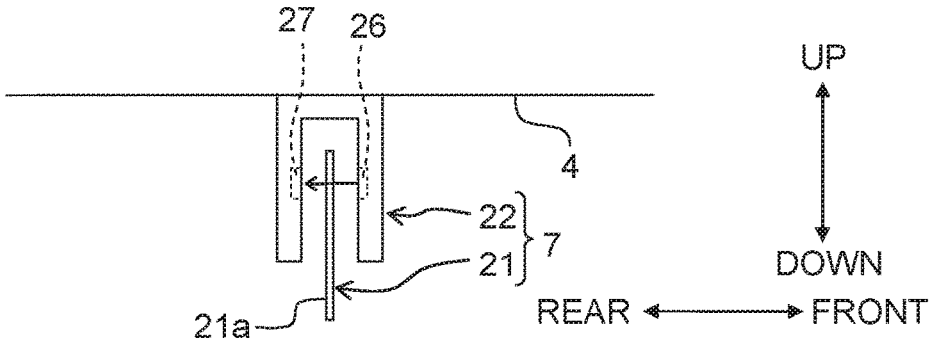
FIG. 3B is a diagram depicting a state in which the detection sensor is facing a transmissive area.
Figure 3C:
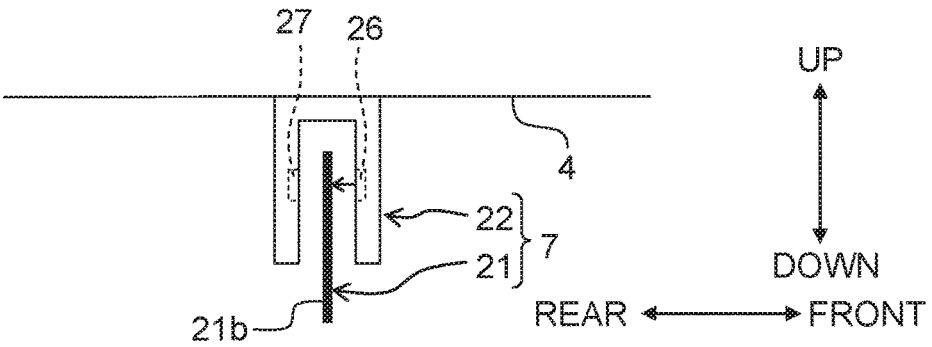
FIG. 3C is a diagram depicting a state in which the detection sensor is facing a non-transmissive area.

Specifically, as depicted in FIG. 3B, when the transmissive area 21*a* is the detection position of the detection sensor 22, the light irradiated from the light-emitting element 26 is transmitted through the transmissive area 21*a* and is received by the light-receiving element 27. Whereas, as depicted in FIG. 3C, when the non-transmissive area 21*b* is the detection position of the detection sensor 22, the light irradiated from the light-emitting element 26 is shielded by the non-transmissive area 21*b*, and does not reach the light-receiving element 27. Consequently, as the detection position of the detection sensor 22 moves by the carriage 4 moving in the scanning direction, a state in which the light from the light-emitting element 26 is received and a state in which the light from the light-emitting element 26 is not received are repeated alternately.

Figure 4A:
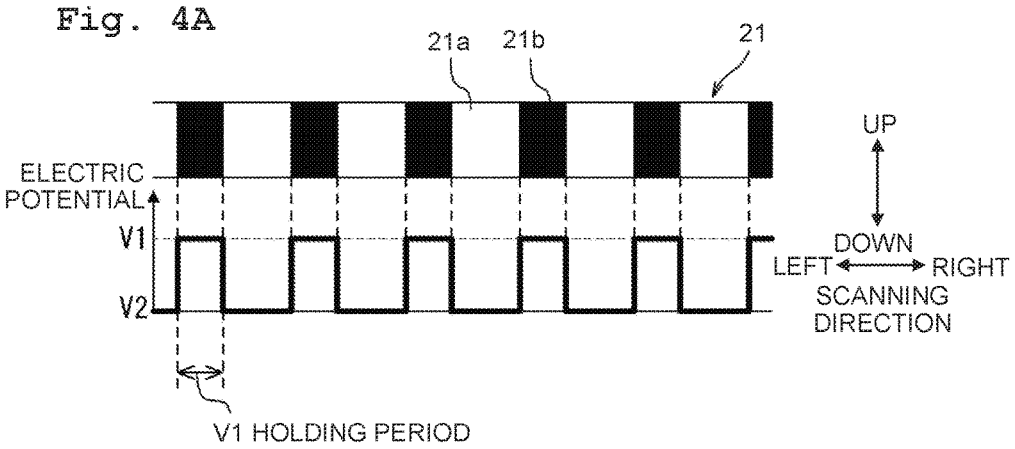
FIG. 4A is a diagram depicting a pulse signal when there is no dirt (contamination) adhered to the scale.

As depicted in FIG. 4A, the optical sensor 22 outputs a pulse signal for which an electric potential when the light-receiving element 27 does not receive the light from the light-emitting element 26 becomes V1 and an electric potential when the light-receiving element 27 receives the light from the light-emitting element 26 becomes V2 (V2<V1). In other words, the pulse signal output from the detection sensor 22 indicates that the detection sensor 22 has detected the non-transmissive area 21*b* when the electric potential is V1, and indicates that the detection sensor 22 has detected the transmissive area 21*a* when the electric potential is V2. Details will be described later. In the present embodiment, the controller 100 acquires the velocity of the carriage 4 (hereinafter, also referred to as carriage velocity Vcr) on the basis of a result of detection by the detection sensor 22.

As depicted in FIG. 2, the cap 8 is arranged on a right side of the platen 41, and correspondingly, in the printer 1, the carriage 4 is movable up to a stand-by position at which the nozzle surface 10*a* is facing the cap 8. The cap 8 can be moved in the vertical direction by an ascending and descending mechanism (not depicted in the diagram). When the carriage 4 is positioned at the stand-by position, as the cap 8 is moved upward and brought closer to the head 5, the cap 8 makes a close contact with the nozzle surface 10*a*, and the plurality of nozzles 10 is covered by the cap 8. The cap 8 is not restricted to make a close contact with the nozzle surface 10*a*, and in a case in which the head 5 has a frame which is arranged to surround the nozzle surface 10*a* for example, the cap 8 may cover the nozzles 10 by making a close contact with the frame. In the printer 1, in a case in which the printing has not been carried out, the carriage 4 is positioned at the stand-by position, and the plurality of nozzles 10 is in a state of being covered by the cap 8. Accordingly, drying of an ink in the nozzles 10 is prevented.

The flushing receiver 9 is arranged on a left side of the platen 41, and correspondingly, in the printer 1, the carriage 4 is movable up to a flushing position at which the nozzle surface 10*a* is facing the cap 8. When the carriage 4 is positioned at the flushing position, the flushing in which, thickened ink inside each nozzle 10 is discharged by jetting the ink from each nozzle 10, is carried out. The flushing position is not necessarily required to be a position at which the nozzle surface 10*a* is facing the flushing receiver 9, and in a case of carrying out the flushing while the carriage moves, the flushing position may be a position before the flushing receiver 9 in a direction of movement of the carriage 4, depending on the velocity of the carriage 4.

Figure 5A:
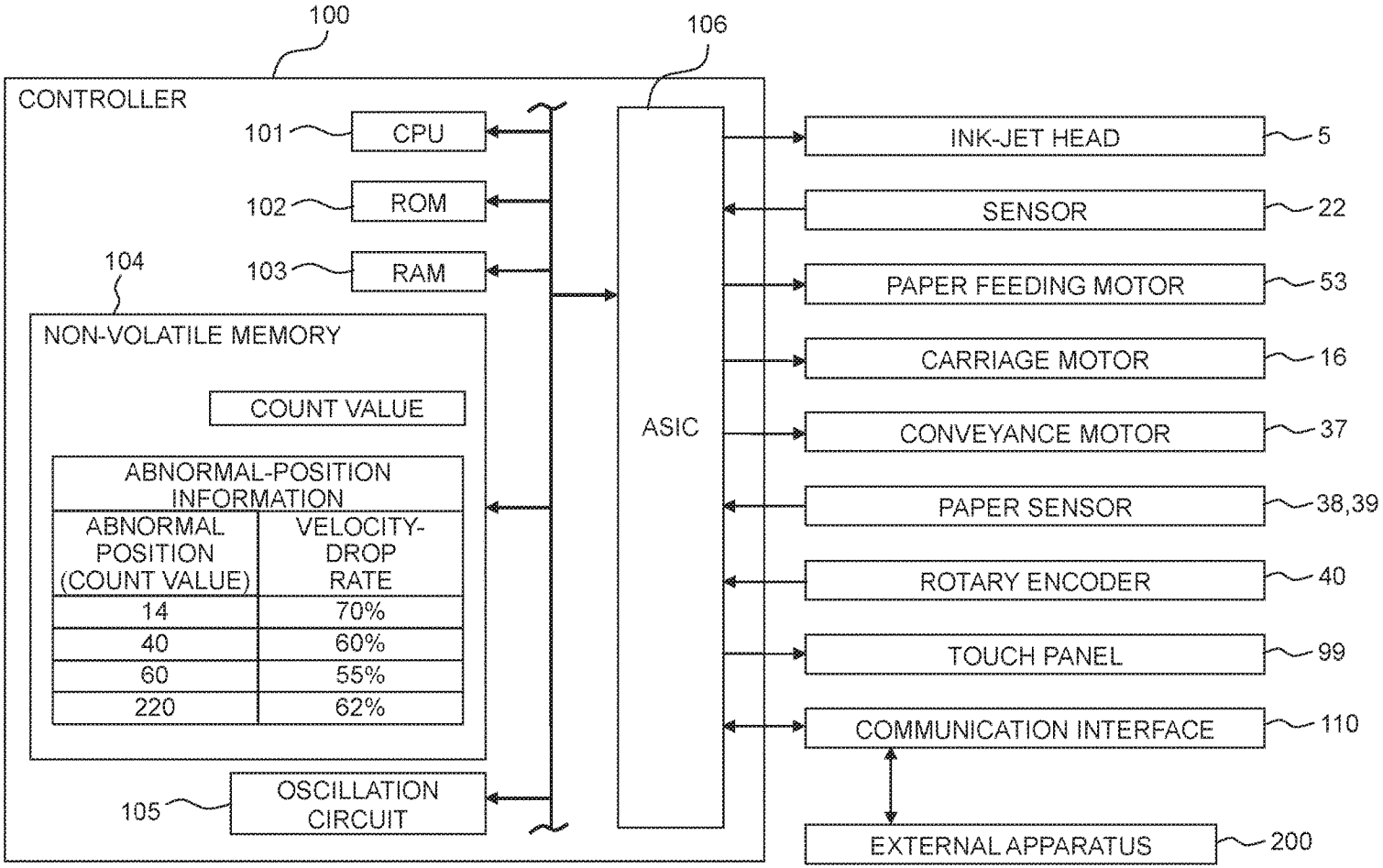
FIG. 5A is a block diagram depicting an electrical configuration of a printer.

As depicted in FIG. 5A, the controller 100 includes a CPU (Central Processing Unit) 101, a ROM (Read Only Memory) 102, a RAM (Random Access Memory) 103, a non-volatile memory 104, an oscillation circuit 105, and an ASIC (application specific integrated circuit) 106. Computer programs to be executed by the CPU 101 and various fixed data are stored in the ROM 102. Data (such as image data) which is necessary at the time of executing a computer program is stored temporarily in the RAM 103. Abnormal-position information that will be described later, is stored in the non-volatile memory 104. Clock signals of frequency determined in advance are stored in the oscillation circuit. Various units or drive sections of the printer 1 such as the head 5, the detection sensor 22, the carriage motor 16, the conveyance motor 37, the paper sensor 38, a touch panel 99, and a communication interface 110 are connected to the ASIC 106.

The CPU 101, by executing a computer program stored in the ROM 102, carries out various processing of controlling an operation of the head 5 and the carriage motor 16 etc. via the ASIC 106. Although the description below is made assuming that various processing are executed by the CPU 101, the controller 100 may include a plurality of CPUs, and the processing may be carried out upon being shared by the plurality of CPUs. Moreover, the controller 100 may include a plurality of ASICs, and the processing may be carried out upon being shared by the plurality of ASICs. Or, one ASIC may carry out the processing independently. A processing of the CPU 101 executed according to a computer program stored in the ROM 102 will be described below.

The CPU 101, upon receiving a print command from an external equipment such as a PC (personal computer) via the communication interface 110, controls the head 5, the carriage motor 16, and the conveyance motor 37, and executes a print processing of printing an image on the paper P according to image data stored in the RAM 103.

Specifically, as the CPU 101 receives the print command, firstly, the CPU 101 generates jetting data by executing an image processing such as a known dithering (quantization processing) on the image data stored in the RAM 103. The jetting data is data of three gradations or tones corresponding to an amount jetted of three types of an ink that can be jetted from the nozzle 10 in one jetting cycle. Moreover, the CPU 101 controls the pickup roller 52 and the conveyance motor 37, and conveys the paper P from the paper feeding tray 51 toward the facing area A. Thereafter, the CPU 101 makes a judgment of whether or not the paper P is positioned in the facing area A, on the basis of a detection result of the paper sensor 38. Moreover, when the CPU 101 has made a judgment that the paper P is positioned in the facing area A, the CPU 101 starts the print processing according to the jetting data that has been generated. In the print processing, the CPU 101 executes alternately a jetting processing of making the ink jetted from the nozzle 10 on the basis of the jetting data, and a transporting processing of making the conveyance mechanism 6 transport the paper P frontward by a predetermined amount.

In the jetting processing of printing a first pass, the CPU 101 controls the movement of the carriage 4 by a feedback control on the basis of a deviation between the current carriage velocity Vcr acquired on the basis of a result of detection by the detection sensor 22 and a target velocity, such that the carriage moves with a constant velocity at the target velocity. Moreover, in the printer 1, it is possible to set velocities of a plurality of stages as the target velocity of the carriage 4. The CPU 101 sets one of these velocities of the plurality of stages as the target velocity in accordance with a print instruction (instructions such as an instruction related to a resolution in the scanning direction of an image to be printed on the paper P, included in the print instructions) and a print range in the pass, and controls the carriage motor 16 such that the carriage 4 moves at the target velocity in the jetting processing.

Figure 6A:
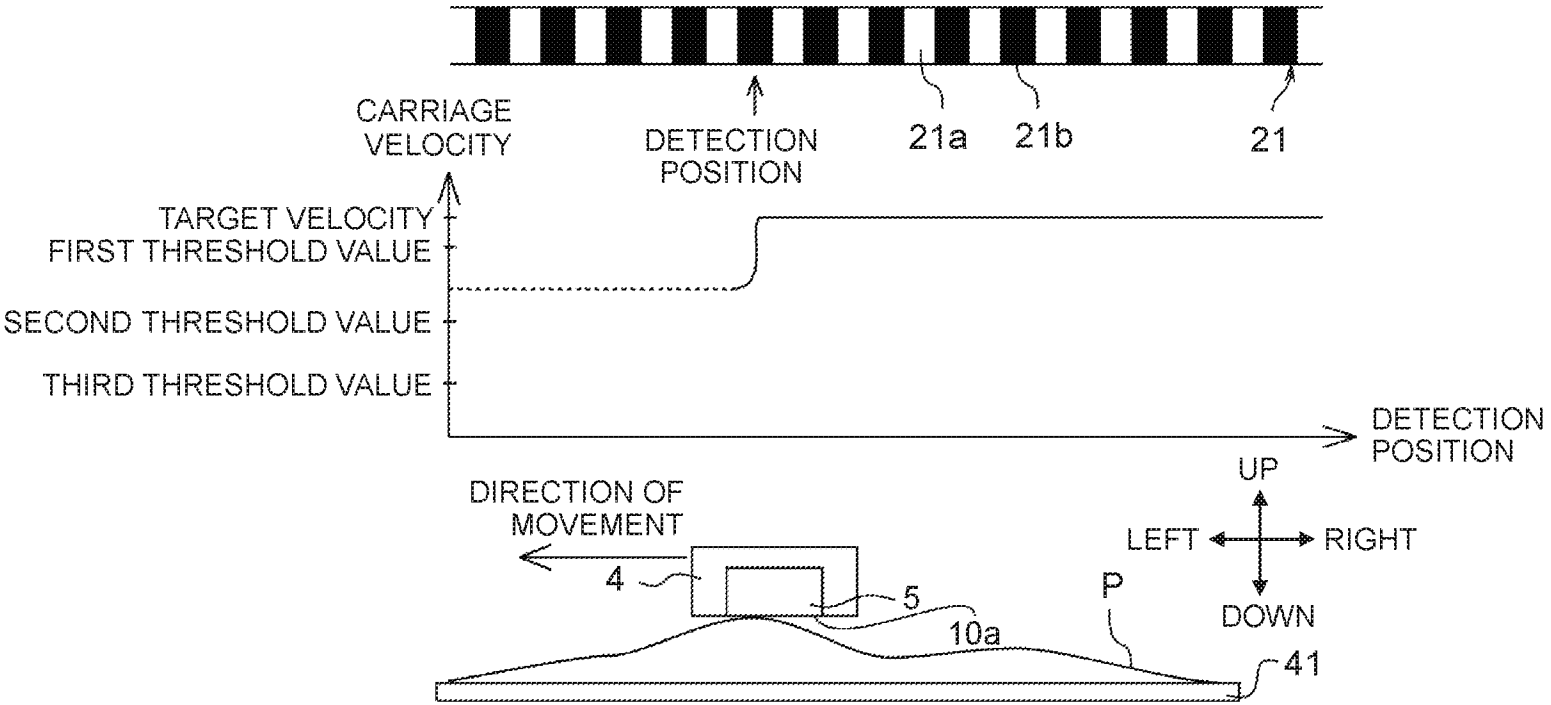
FIG. 6A and FIG. 6B are explanatory diagrams describing factors that lower a carriage velocity acquired on the basis of a result of detection by a detection sensor, where.

Incidentally, as the paper P absorbs the ink, there is a deformation of paper such as cockling and curling. When such paper deformation occurs, sometimes, there might be rubbing between the paper P moving through the carriage 4 and the nozzle surface 10*a* of the head 5 (hereinafter, 'paper rubbing') as depicted in FIG. 6A, at the time of carrying out printing of the subsequent pass. When the carriage is moved continuously in a state of the paper rubbing occurring, it becomes a cause of jamming and a jetting defect of an ink due to a damage of the nozzle surface.

Thereafter, the CPU 101, at the time of moving the carriage 4, acquires the carriage velocity Vcr which is the current velocity of the carriage 4, and makes a judgment of whether or not the paper rubbing has occurred, on the basis of the carriage velocity Vcr. Moreover, in a case in which the CPU 101 has a made a judgment that the paper rubbing has occurred, the CPU 101 carries out processing such as stopping the movement of the carriage 4. This will be described below in detail.

In the jetting processing, as mentioned earlier, the CPU 101 controls the carriage motor 16 to move the carriage 4 at the target velocity. During this control, the carriage 4, although having some effect of a motor fluctuation, moves at the target velocity approximately. However, when there is a paper rubbing, due to a frictional force between the nozzle surface 10*a* and the paper P, the carriage velocity Vcr drops substantially below the target velocity. Consequently, when the carriage velocity Vcr acquired during the control of the carriage motor 16 is lower compared to a predetermined threshold value (hereinafter, 'first threshold value'), it is possible to make a judgment that the paper rubbing has occurred. The first threshold value is a value corresponding to a velocity slower than the target velocity, and a difference in the target velocity and the threshold value is larger than an amount of drop in the velocity due to the motor fluctuation. For instance, in a case in which, the carriage velocity Vcr fluctuates by about 5% due to the motor fluctuation with respect to the target velocity, the first threshold value is to be set to a value which is 90% of the target velocity.

It is possible to calculate the carriage velocity Vcr using the following expression (1). In expression (1), W denotes an area width of the scanning direction of the one non-transmissive area 21*b* and F denotes a frequency of a clock signal output from the oscillation circuit 105. Moreover, CK denotes a clock number output from the oscillation circuit 105 while the detection sensor 22 detects the non-transmissive area 21*b*.

$$Vcr = W/(CK/F) \quad \text{(expression 1)}$$

In expression (1), the area width W and the frequency F being fixed values determined in advance, it is possible to calculate the carriage velocity Vcr by acquiring the clock number CK. Moreover, it is possible to acquire the clock number CK by counting the clocks of the clock signal output from the oscillation circuit 105 during a period from a point of time at which an electric potential of the pulse signal output from the detection sensor 22 rises from V2 to V1 up to a point of time at which the electric potential of the pulse signal output from the detection sensor 22 falls from V1 to V2, or in other words, a period during which the electric potential of the pulse signal is held at V1 (hereinafter, also referred to as V1 holding period). Thus, it is possible to make a judgment of paper rubbing by acquiring the carriage velocity Vcr on the basis of the result of detection by the detection sensor 22 during the movement of the carriage 4. Acquiring the carriage velocity Vcr is executed every time the electric potential of the pulse signal output from the detection sensor 22 falls from V1 to V2.

Figure 6B:
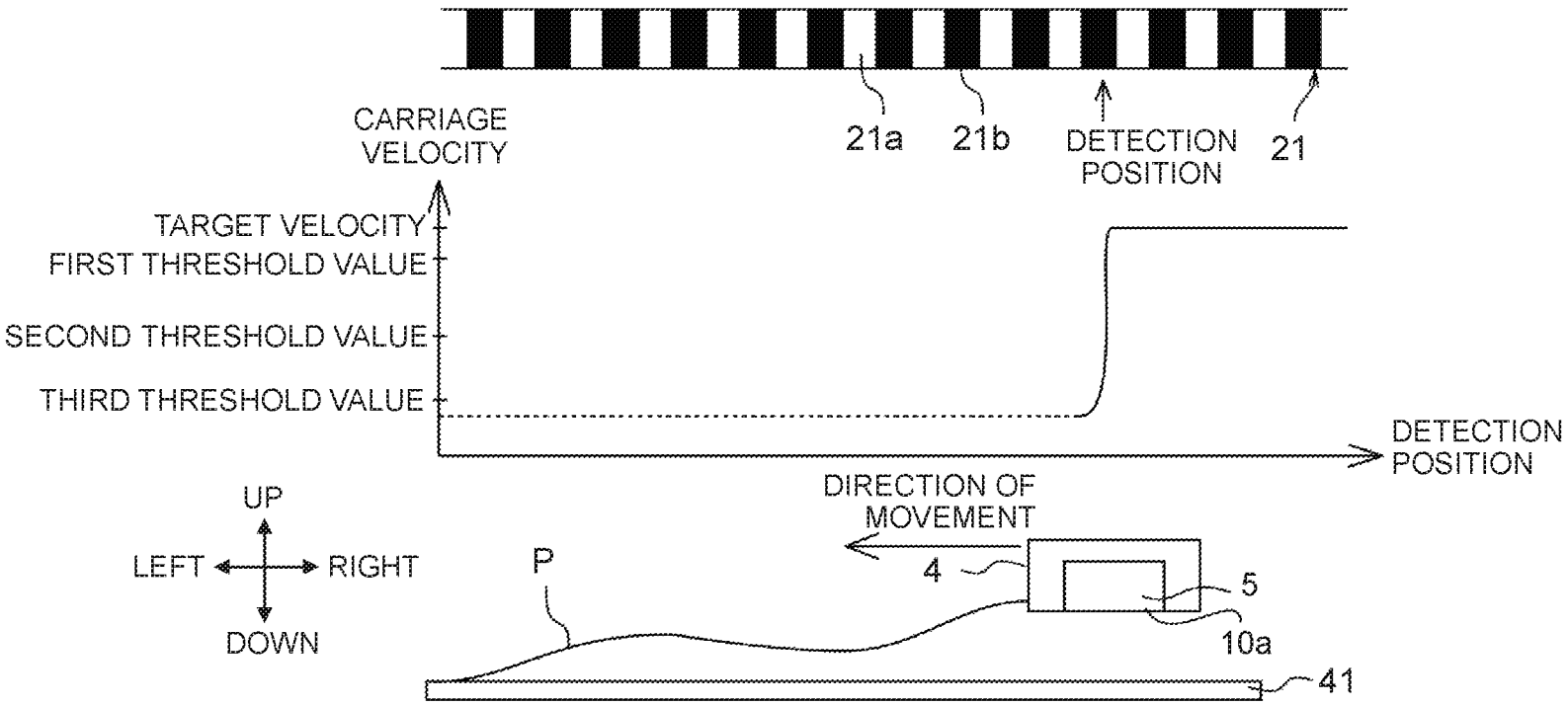

Moreover, as depicted in FIG. 6B, in a case in which, the paper P has deformed to be lifted off substantially upward, sometimes the jamming might occur due to the paper P striking a side surface of the carriage 4 during the movement of the carriage 4. When such jamming occurs, the carriage velocity Vcr drops substantially than that in the case of paper rubbing. Therefore, when the carriage velocity Vcr acquired on the basis of the result of detection by the detection sensor 22 is slower compared to a third threshold value corresponding to a velocity slower than the first threshold value, the CPU 101 makes a judgment that the jamming has occurred. The third threshold value is to be set to a value which is 30% of the target velocity.

Incidentally, the scale 21 becomes defective due to a part thereof being stained by ink dirt etc. For instance, when the jamming occurs, the jammed paper is removed by a user, and while the paper is being removed, sometimes the ink is adhered to the scale 21 thereby staining the scale 21. Moreover, sometimes a so-called rimless printing (edgeless printing, borderless printing) in which, the printing is carried out throughout the overall length in the scanning direction of the paper P by jetting the ink from the nozzles 10 over a range wider than the length in the scanning direction of the paper P, is also carried out. Since generally, a jetting energy applied to the ink at the time of making the ink jet from nozzle 10 is not more than an energy required for making the ink land on an upper surface of the paper P supported by the platen 41, in the rimless printing, some of the ink jetted from the nozzles in a range at an outer side in the scanning direction of the paper P turns into mist without landing on the platen 41. The ink turned into mist may get adhered to the scale 21 thereby staining the scale 21.

When there is a defect due to the dirt adhering to the scale 21 as described above, the pulse signal output from the detection sensor 22 being different from the pulse signal that is to be output normally, sometimes, the carriage velocity Vcr acquired on the basis of the detection sensor 22 may be slower than the actual velocity. This will be described below specifically.

In a case in which the portion having a dirt adhered thereto is the non-transmissive area 21*b*, the non-transmissive area 21*b* being an area which basically shields light, due to the dirt on the non-transmissive area 21*b*, the pulse signal output from the detection sensor 22 does not differ from the pulse signal that is to be output basically.

On the other hand, in a case in which, the portion having a dirt adhered thereto is the transmissive area 21*a*, the light irradiated from the light-emitting element 26 is shielded by the dirt on the transmissive area 21*a*, and does not reach the light-receiving element 27. As a result, due to the dirt on the transmissive area 21*a*, the pulse signal output from the detection sensor 22 differs from the pulse signal that is to be output basically.

Figure 4B:
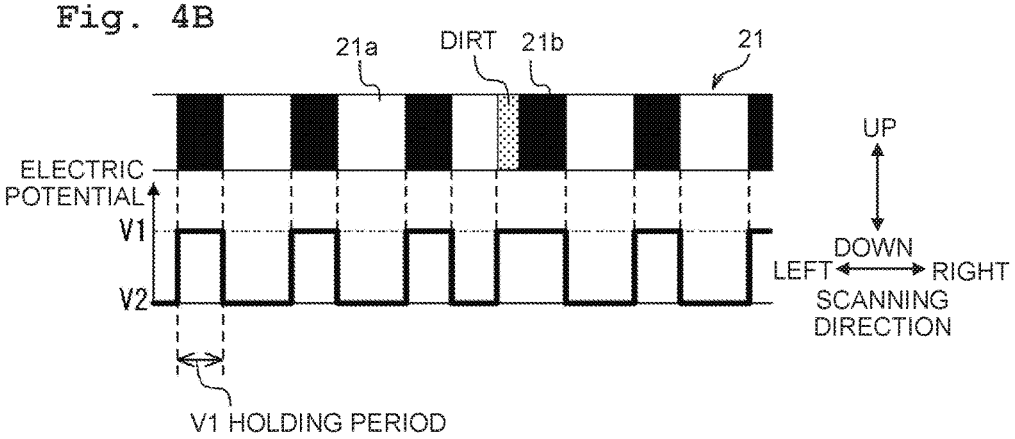
FIG. 4B and FIG. 4C are diagrams depicting a pulse signal when dirt is adhered to the scale.

For instance, as depicted in FIG. 4B, when a dirt continued to any one of the two adjacent non-transmissive area 21*b* on two sides of the transmissive area 21*a* is adhered to the transmissive area 21*a*, during the period in which the detection position of the detection sensor 22 is at the dirt portion, in addition to the period in which the detection position is at the one non-transmissive area 21*b*, the electric potential is held at V1.

Figure 4C:
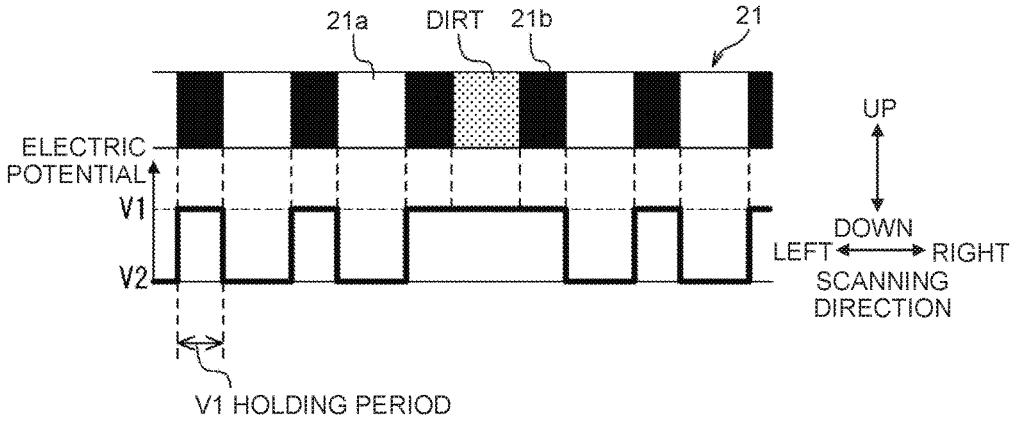

Moreover, as depicted in FIG. 4C, when the dirt is adhered to the overall transmissive area 21*a*, during the period in which the detection position of the detection sensor 22 is at the one non-transmissive area and one transmissive area to which the dirt is adhered, in addition to the period in which the detection position is at the one non-transmissive area 21*b*, the electric potential is held at V1.

Figure 7A:
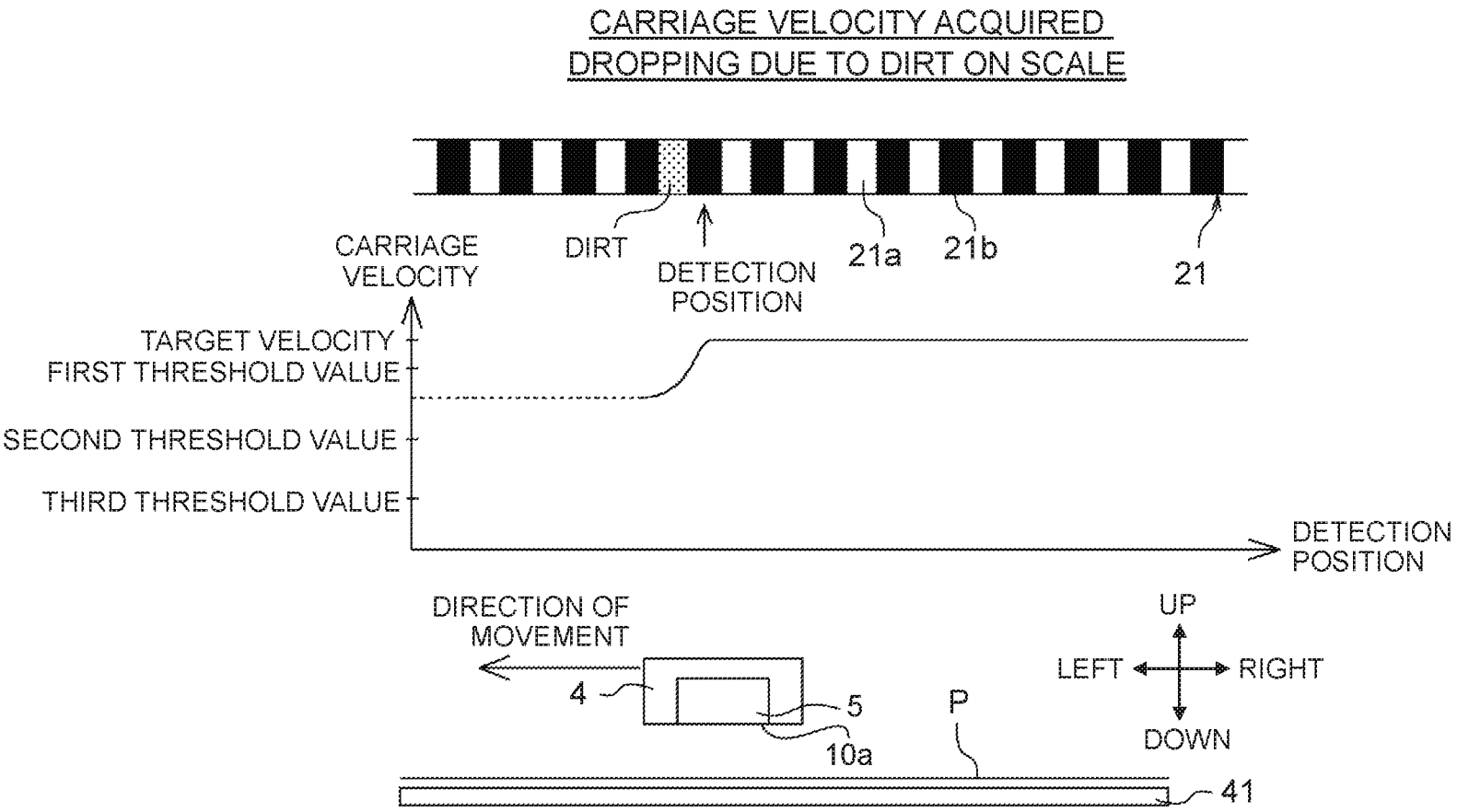
FIG. 7A and FIG. 7B are explanatory diagrams describing factors that lower the carriage velocity acquired on the basis of the result of detection by the detection sensor, where.

As described above, when the dirt is adhered to the transmissive area 21*a* of the scale 21, the V1 holding period during which the electric potential is held at V1 is longer than the period during which the detection position of the detection sensor 22 is at the one non-transmissive area 21*b*. As a result of this, the clock number CK acquired during the V1 holding period becomes greater (higher) than the clock number that is counted during the period during which the detection position of the detection sensor 22 is at the one non-transmissive area 21*b*. In other words, the clock number CK in expression (1) is greater than the actual value. On the other hand, in expression (1), the area width W for the non-transmissive area 21*b* is a fixed value. Therefore, by the clock number CK becoming greater than the actual value, the carriage velocity Vcr calculated by using expression (1) becomes slower than the actual velocity. As a result of this, as depicted in FIG. 7A, in spite of the paper rubbing not occurring, when the carriage velocity Vcr becomes smaller than the first threshold value, the CPU 101 makes a judgment erroneously that the paper rubbing has occurred. Accordingly, the movement of the carriage 4 stops, and the print processing being suspended unnecessarily, the usability of the printer 1 is degraded.

Therefore, in the present embodiment, in order to solve this problem, the CPU 101, before the print processing, generates abnormal-position information related to an abnormal position on the scale 21, and executes an abnormal-position detection processing stored in the non-volatile memory 104.

Moreover, during the control of the carriage motor 16 in the print processing, the CPU 101 executes a judgment processing in which, in a case in which the detection position of the detection sensor 22 it at a position other than the abnormal position, the CPU 101 makes a judgment of paper rubbing by using the first threshold value, and in a case in which the detection position of the detection sensor 22 is at the abnormal position, the CPU 101 makes a judgment of paper rubbing by using a second threshold value which is different from the first threshold value. The second threshold value is a threshold value which is smaller than the first threshold value, and larger than the third threshold value. Moreover, the CPU 101 executes a threshold-value setting processing of setting these first threshold value, the second threshold value, and the third threshold value (hereinafter, 'first threshold value to third threshold value'). These processing will be described below in detail.

In the abnormal-position detection processing, in a case in which a judgment has been made that the paper P is not positioned in the facing area A, the CPU 101 controls the carriage motor 16 and moves the carriage 4 in the scanning direction at a constant velocity. A range of movement of the carriage 4 at this time is a range from the stand-by position up to the flushing position. Thereafter, the CPU 101, on the basis of the result of detection by the detection sensor 22 during the movement of the carriage 4, generates for each abnormal position, abnormal-position information which includes the abnormal position on the scale and a rate at which the velocity drops (velocity-drop rate) which will be described later, corresponding to the abnormal position. This will be described below specifically.

During the abnormal-position detection processing, the paper P not being positioned in the facing area A, there is no slowing of the carriage velocity Vcr due to paper rubbing, and the carriage 4 moves at a constant speed which is substantially the same as the target velocity that has been set. Consequently, in the case is which, there is no dirt adhered to the scale 21, as depicted in FIG. 4A, a length of each of V1 holding period is same for all, and is same as the period for which the detection sensor 22 detects one non-transmissive area 21*b*. Therefore, the carriage velocity Vcr which is calculated by substituting the clock number CK acquired in each V1 holding period as a variable in expression (1) is substantially the same as the target velocity that has been set.

On the other hand, as depicted in FIG. 4B and FIG. 4C, in the case in which the dirt continued to the non-transmissive area 21*b* is adhered to any of the transmissive areas 21*a* on the scale 21, a position of a portion of dirt of this transmissive area 21*a* and a position of the non-transmissive area 21*b* become the abnormal position. Moreover, when the detection position of the detection sensor 22 is at this abnormal position, the V1 holding period becomes longer as compared to that when the detection position is a position other than the abnormal position, and the clock number CK acquired during this V1 holding period becomes large (high). For this reason, the carriage velocity Vcr calculated by substituting this clock number CK as a variable in expression (1) becomes slower than the target velocity that has been set. Accordingly, in a case in which the carriage velocity Vcr that has been calculated is slower than a predetermined threshold value, the CPU 101 makes a judgment that the current detection position of the detection sensor 22 is the abnormal position on the scale 21. The threshold value is a velocity slower than the target velocity, (influenced) by an amount upon taking into consideration an error due to a disturbance of the motor fluctuation etc.

The current detection position of the detection sensor 22 is acquired by counting the number of non-transmissive areas 21*b* detected by the detection sensor 22 from the stand-by position of the carriage 4. A count value indicating the number of detections of the non-transmissive area 21*b* detected by the detection sensor from the stand-by position of the carriage 4 is stored in the non-volatile memory 104. Thereafter, at the time of the carriage 4 moving leftward along the scanning direction, the CPU 101 counts up the count value that has been stored in the non-volatile memory 104 by 1 every time the non-transmissive area 21*b* has been detected (the electric potential rises from V2 to V1) by the detection sensor 22. On the other hand, at the time of the carriage 4 moving leftward along the scanning direction, the CPU 101 counts down the count value that has been stored in the non-volatile memory 104 by 1 every time the non-transmissive area 21*b* has been detected by the detection sensor 22. Accordingly, it is possible to acquire the current detection position of the detection sensor 22.

In such manner, the CPU 101 makes a judgment of the abnormal position on the scale 21. Moreover, the CPU 101 calculates the rate at which the velocity drops due to the dirt at the abnormal position from the carriage velocity Vcr acquired corresponding to each abnormal position. Specifically, the CPU 101 lets a proportion (ratio) of the carriage velocity Vcr that has been acquired when the target velocity is let to be 100, to be the rate at which the velocity drops. Thereafter, the CPU 101 generates for each abnormal position, the abnormal-position information which includes this abnormal position and the velocity-drop rate corresponding to this abnormal position, and stores in the non-volatile memory 104. The control of velocity of the carriage 4 during the abnormal-position detection processing is also carried out by the feedback control based of the deviation between the target velocity and the carriage velocity Vcr acquired on the basis of the result of detection by the detection sensor 22. In this case, when the carriage velocity Vcr that has been acquired becomes slower than the actual velocity due to the dirt on the scale 21, it is not possible to carry out the feedback control appropriately. Accordingly, in a case in which the carriage velocity Vcr that has been acquired is slower than the predetermined threshold value, an arrangement may be made such the carriage velocity Vcr that has been acquired is not to be used as a parameter of the feedback control.

When the carriage 4 undergoes an acceleration or a deceleration movement, since the carriage velocity Vcr fluctuates substantially due to reasons such as a substantial motor fluctuation, in a case in which the abnormal-position information has been generated on the basis of the result of detection by the detection sensor 22, sometimes an accuracy thereof may be low. On the other hand, when the control is carried out such that the carriage 4 moves at a constant velocity, the fluctuation in the carriage velocity Vcr is small. Therefore, as in the present embodiment, by controlling such that the carriage 4 moves at a constant velocity, and generating the abnormal-position information on the basis of the result of detection by the detection sensor 22, it is possible to improve the accuracy thereof. Moreover, in the present embodiment, the target velocity of the carriage 4 that is to be set in the abnormal-position detection processing is the fastest velocity among the velocities of the plurality of stages. Accordingly, it is possible to shorten a time required for the abnormal-position detection processing.

In the threshold-value setting processing, the CPU 101 sets the first threshold value and the third threshold value according to the target velocity of the carriage 4 in the jetting processing of the print processing. For instance, as mentioned above, the value which is 90% of the target velocity is to be set as the first threshold value and the value which 30% of the target velocity is to be set as the third threshold value. Moreover, the CPU 101 sets the second threshold value for each abnormal position on the scale 21 on the basis of the target velocity of the carriage 4 in the jetting processing and the abnormal-position information stored in the non-volatile memory 104. For instance, the second threshold value for a certain abnormal position is to be set to be a value which is 90% of a value achieved by multiplying the target velocity by the rate at which the velocity drops (the velocity-drop rate) corresponding to that certain abnormal position. However, a method for setting the second threshold value is not restricted to the abovementioned method, and a relationship of the velocity-drop rate and the second threshold value corresponding to each target velocity is stored in the ROM 102 as a table or a calculation formula, and by using this relationship, the second threshold value may be set on the basis of the velocity-drop value acquired in the abnormal-position detection processing.

At the time of setting the second threshold value for each abnormal position, in a case in which the second threshold value is smaller than the third threshold value, since the range (area) of the dirt on the scale 21 is large (wide), and it is possible to make a judgment of paper-rubbing with high accuracy, an error screen may be displayed on the touch panel 99. Or, as an exception, only for this abnormal position, the third threshold value may be set to be smaller than the second threshold value. As described above, by setting the first threshold value to the third threshold value according to the target velocity of the carriage 4, it is possible to make the judgment of paper rubbing or jamming with high accuracy. Moreover, by setting the second threshold value for each abnormal position on the basis of the velocity-drop rate, it is possible to make a judgment of the paper rubbing with high accuracy.

Figure 7B:
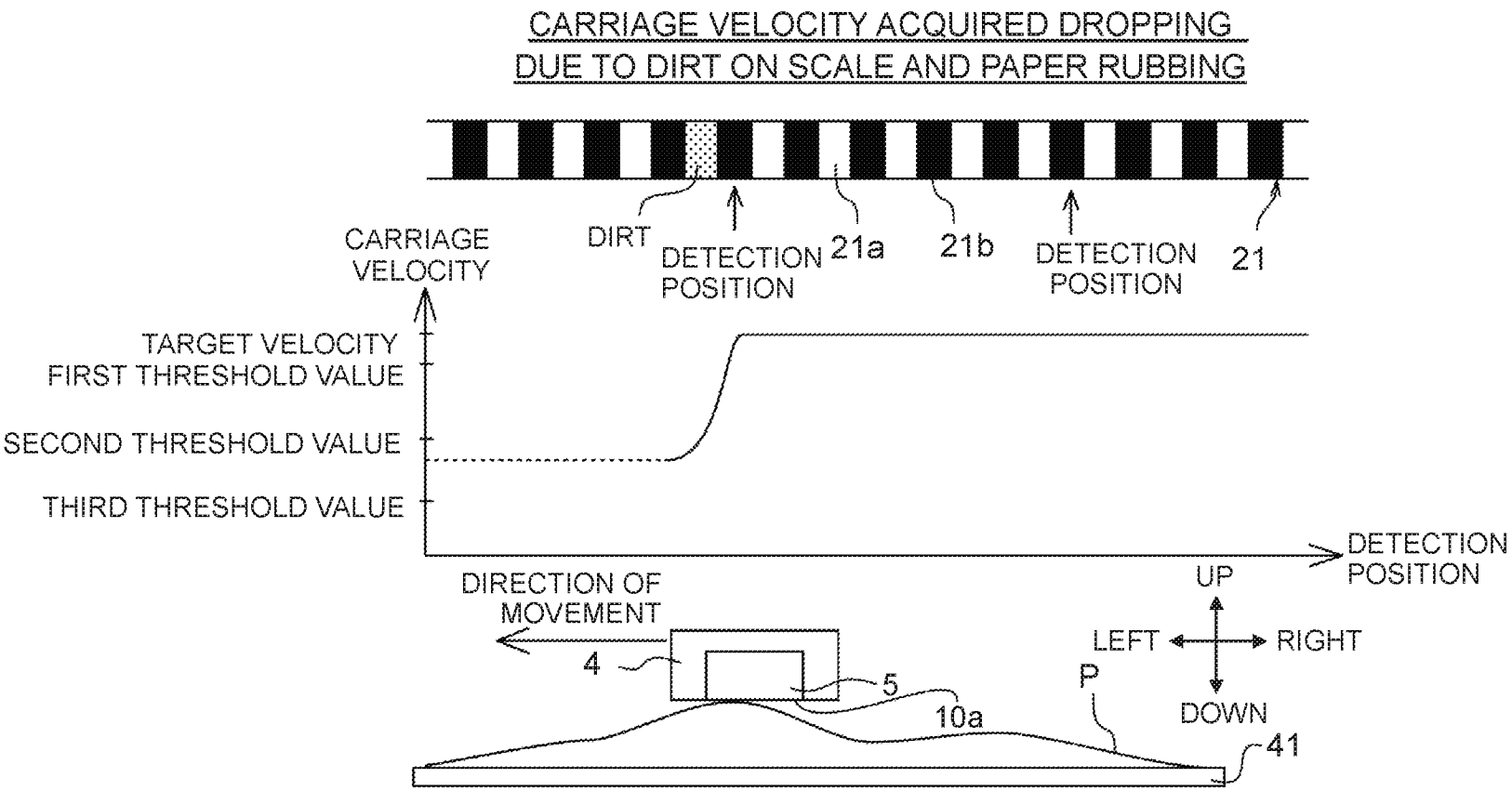

In a rubbing judgment processing, as depicted in FIG. 5B and FIG. 6A, during the control of the carriage motor 16 in the print processing, when the detection position of the detection sensor 22 is a position other than the abnormal position in the abnormal-position information stored in the non-volatile memory 104, in a case in which the carriage velocity Vcr acquired at that time is less than the first threshold value and not less than the third threshold value, the CPU 101 makes a judgment that the paper rubbing has occurred. Moreover, during the control of the carriage motor 16 in the print processing, when the detection position of the detection sensor is the abnormal position, in a case in which the carriage velocity Vcr acquired at that time is less than the second threshold value corresponding to that abnormal position, and not less than the third threshold value, as depicted in FIG. 7B, the CPU 101 makes a judgment that the paper rubbing has occurred. The judgment of whether or not the paper rubbing is there is made every time the carriage velocity Vcr is acquired. In a case in which the carriage velocity Vcr that has been acquired is less than the third threshold value as depicted in FIG. 5B, the CPU 101, regardless of the detection position of the detection sensor 22, makes a judgment that the jamming has occurred.

A series of operations of the printer 1 will be described below while referring to FIGS. 8A, 8B and FIG. 9. At the time of start of an operation flow in FIGS. 8A and 8B, the carriage 4 is positioned at the stand-by position, and there is no paper P in the conveyance path including the facing area A.

Figure 8A:
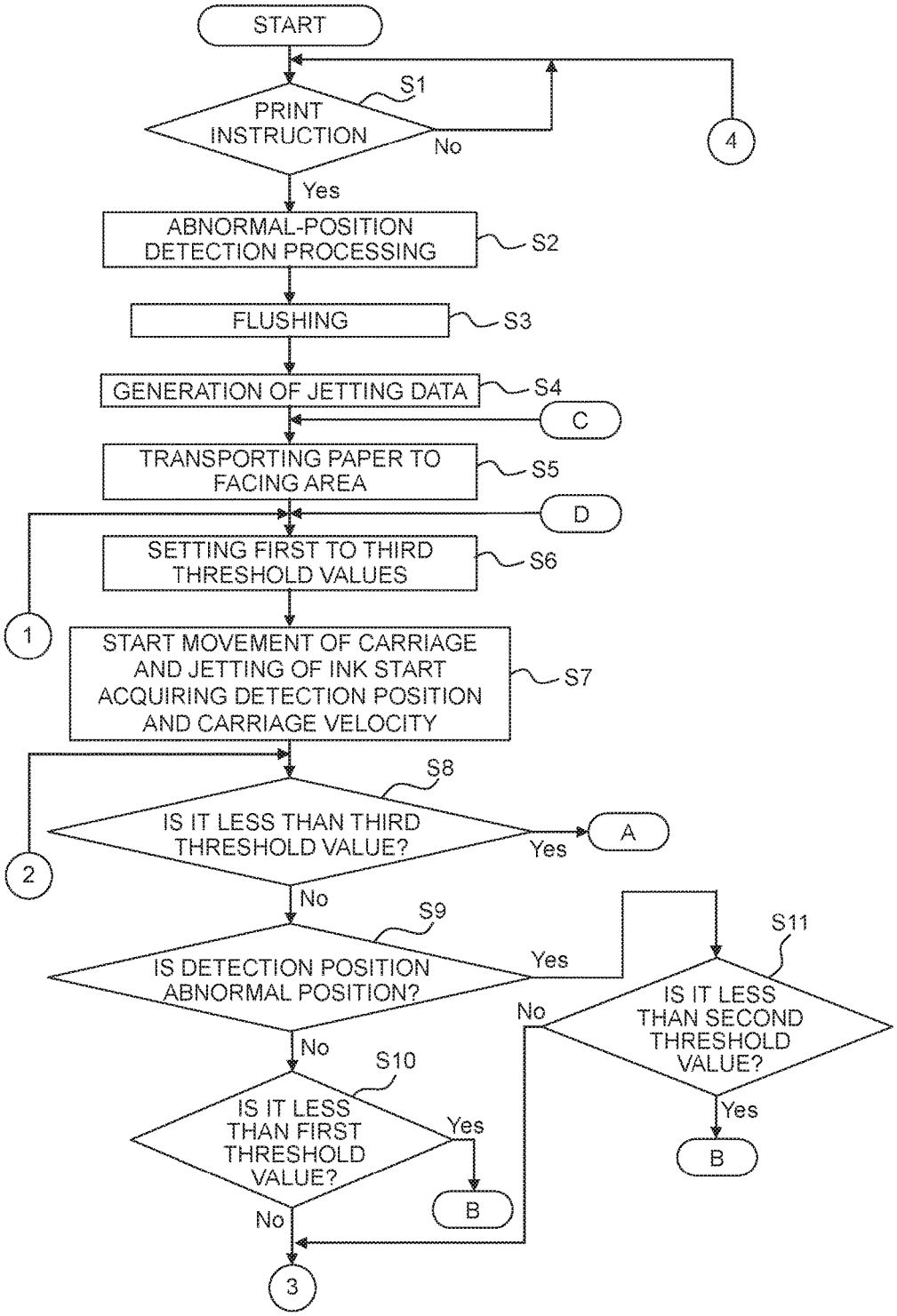
FIGS. 8A and 8B are flowcharts depicting an operation of the ink-jet printer.
Figure 8B:
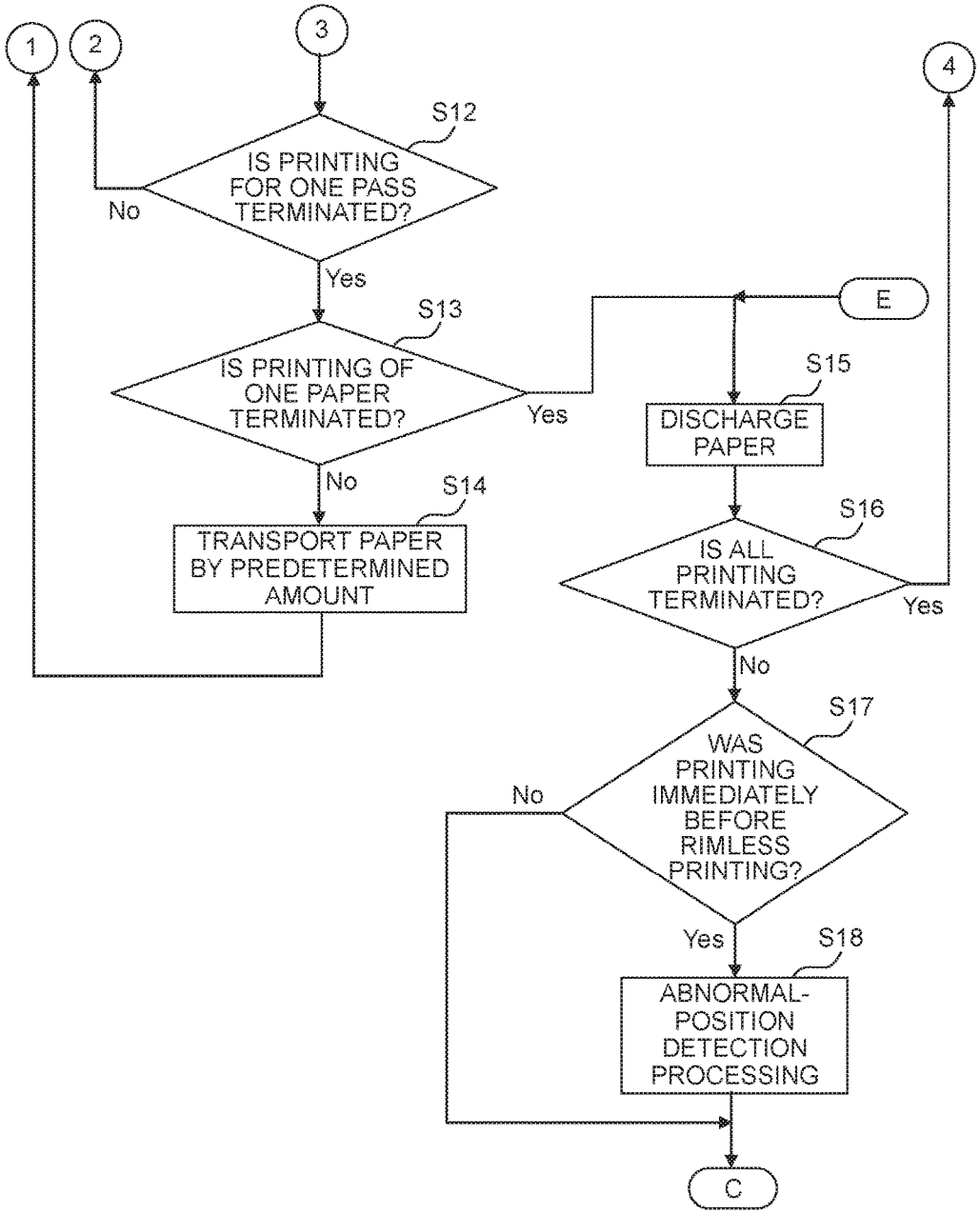

As depicted in FIG. 8A, as the CPU 101 receives a print command from an external apparatus 200 (YES at step S1), since the paper P is yet to be transported to the facing position A, the CPU 101 makes a judgment that the paper P is not positioned at the facing area A, and executes the abnormal-position detection processing (step S2). Specifically, the CPU 101, by controlling the carriage motor 16, moves the carriage 4 at a constant velocity from the stand-by position up to the flushing position with the maximum velocity that can be set as the target velocity. Moreover, the CPU 101 generates the abnormal-position information on the basis of the result of detection by the detection sensor 22 during the movement of the carriage 4, and stores in the non-volatile memory 104.

Next, the CPU 101 executes a flushing processing of making the head 5 carry out the flushing (step S3). Accordingly, it is possible to discharge the thickened ink inside the nozzles 10. Moreover, the CPU 101 generates jetting data from image data stored in the RAM 103 (step S4). Next, the CPU 101, by controlling the pickup roller 52 and the conveyance motor 37, transports the paper P in the paper feeding tray 51 up to the facing area A (step S5). Since the paper P is transported to the facing area A at step S5, the CPU 101 makes a judgment that the paper P is positioned at the facing area A.

Furthermore, the CPU 101 executes the threshold-value setting processing of setting the first threshold value and the third threshold value according to the target velocity of the carriage 4 set in the subsequent jetting processing, and setting the second threshold value for each abnormal position on the basis of the target velocity of the carriage 4 and the abnormal-position information that has been stored in the non-volatile memory 104 (step S6). Thereafter, the CPU 101 starts the jetting processing related to printing for one pass (step S7). In other words, the CPU 101 starts the movement of the carriage 4 in the scanning direction by controlling the carriage motor 4, and starts jetting the ink from the nozzles 10 on the basis of the jetting data by controlling the head 5. During the control of the carriage motor 16, on the basis of the result of detection by the detection sensor 22, the detection position of the detection sensor 22 and the carriage velocity Vcr are acquired. As mentioned earlier, the control of velocity of the carriage 4 during the jetting processing is carried out by the feedback control based on the deviation between the target velocity and the carriage velocity Vcr acquired on the basis of the result of detection by the detection sensor 22. However, when the detection position on the scale 21 of the detection sensor 22 is at the abnormal position, the carriage velocity Vcr acquired at that time becomes slower than the actual velocity. As a result of this, there is a possibility that the control of velocity of the carriage 4 during the jetting processing cannot be carried out appropriately. Accordingly, when the detection position on the scale 21 of the detection sensor 22 is at the abnormal position, an arrangement may be made such that the carriage velocity Vcr that has been acquired is not to be used as a control parameter. Or, the feedback control may be carried out upon correcting the carriage velocity Vcr that has been acquired, by referring to the velocity-drop rate of the abnormal-position information corresponding to the abnormal position that has been stored in the non-volatile memory 104.

Next, the CPU 101 makes a judgment of whether or not the carriage velocity Vcr that has been acquired is less than the third threshold value (step S8). In a case in which the CPU 101 has made a judgment that the carriage velocity Vcr is not less than the third threshold value (NO at step S8), the CPU 101 makes a judgment that the jamming has not occurred, and the process shifts to step S9. Whereas, in a case in which the CPU 101 has a made a judgment that the carriage velocity Vcr is less than the third threshold value (YES at step S8), the CPU 101 makes a judgment that the jamming has occurred, and the process shifts to step S30.

At step S9, the CPU 101, by referring to the abnormal-position information in the non-volatile memory 104, makes a judgment of whether or not the current detection position of the detection sensor is at the abnormal position (step S9). In a case in which, the CPU 101 has a made a judgment that the detection position is a position other than the abnormal position (NO at step S9), the CPU 101 makes a judgment of whether or not the carriage velocity Vcr that has been acquired is less than the first threshold value (step S10). In a case in which, the CPU 101 has made a judgment that the carriage velocity Vcr is not less than the first threshold value (NO at step S10), the CPU 101 makes a judgment that the paper rubbing has not occurred, and the process shifts to step S12. Whereas, in a case in which the CPU 101 has made a judgment that the carriage velocity Vcr is less than the first threshold value (YES at step S10), the CPU 101 makes a judgment that the paper rubbing has occurred, and the process shifts to step S35.

At step S9, in a case in which a judgement has been made that the detection position is the abnormal position (YES at step S9), the CPU 101 makes a judgment of whether or not the carriage velocity Vcr that has been acquired is less than the second threshold value (step S11). Moreover, in a case in which a judgment has been made that the carriage velocity Vcr is not less than the second threshold value (NO at step S11), the CPU 101 makes a judgment that the paper rubbing has not occurred, and the process shifts to step S12. Whereas, in a case in which a judgment has been made that the carriage velocity Vcr is less than the second threshold value (YES at step S11), the CPU 101 makes a judgment that the paper rubbing has occurred, and the process shifts to step S35.

At step S12, the CPU 101 makes a judgment of whether or not the jetting processing (printing equivalent to one pass) is terminated. In a case in which, a judgment has been made that the jetting processing is not terminated (NO at step S12), the process returns to step S8 in order to continue the jetting processing. Whereas, in a case in which a judgment has been made that the jetting processing is terminated (YES at step S12), the CPU 101 makes a judgment of whether or not printing on one paper P is terminated (step S13). In a case in which a judgment has been made that the printing on one paper P is not terminated (NO at step S13), the CPU 101 transports the paper P forward only by a predetermined amount by controlling the conveyance motor 37 (step S14), and the process shifts to step S6 in order to execute printing of the subsequent pass. Whereas, in a case in which a judgment has been made that the printing on one paper P is terminated (YES at step S13), the CPU 101, transports the paper P subjected to printing by controlling the conveyance motor 37, and discharges from the facing area A (step S15), and thereafter, makes a judgment of whether or not the overall printing as per the print command received is terminated (step S16). When a judgment has been made that the overall printing is terminated (YES at step S16), after the CPU 101 has moved the carriage 4 to the stand-by position by controlling the carriage motor 16, the process shifts to step S1.

Whereas, in a case in which a judgment has been made that the printing is not terminated (NO at step S16), the CPU makes a judgment of whether or not the printing of an image on the paper P that was carried out immediately before was a rimless printing (step S17). In a case in which a judgment has been made that the printing was not the rimless printing (NO at step S17), the CPU 101 shifts the process to step S5 in order to execute printing on the subsequent paper P. Whereas, in a case in which a judgment has been made that the printing was the rimless printing (YES at step S17), with the possibility of new dirt adhered to the scale 21, the CPU 101 executes the abnormal-position detection processing (step S18). Accordingly, the abnormal-position information stored in the non-volatile memory 104 is updated. Thereafter, the CPU 101 shifts the process to step S5 in order to execute printing on the subsequent paper P.

Figure 9:
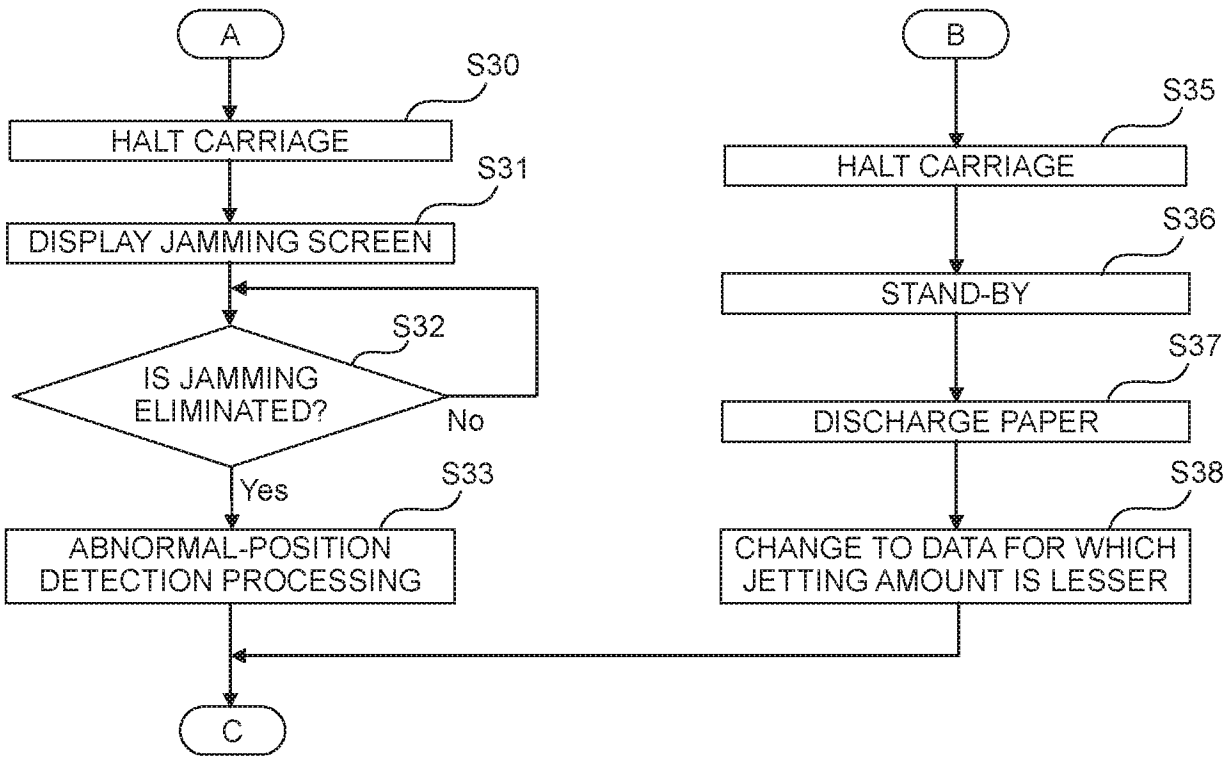
FIG. 9 is a flowchart depicting an operation of the ink-jet printer.

As depicted in FIG. 9, at step S30 which is carried out when the judgement is made that jamming has occurred, the CPU 101 halts the carriage 4 by controlling the carriage motor 16. Moreover, the CPU 101 displays a screen depicting that the jamming has occurred, on the touch panel 99 (step S31). Thereafter, an elimination job of removing the jammed paper is carried out by the user. As an input indicating that the elimination job of removing the paper by the user is finished is received via the touch panel 99 (YES at step S32), the CPU 101, with a possibility that a dirt is developed newly on the scale 21 during the elimination job, executes the abnormal-position detection processing (step S33). Accordingly, the abnormal-position information stored in the non-volatile memory 104 is updated. Thereafter, the CPU 101 shifts the process to step S5 in order to re-execute the printing based on the same jetting data on a new paper P.

In the processing at step S35 which is carried out when the judgment has been made that the paper rubbing has occurred, the CPU 101 halts the carriage 4 by controlling the carriage motor 16. Moreover, the CPU 101 waits for a predetermined time (step S36), and thereafter, by controlling the conveyance motor 37, discharges the paper P subjected to printing from the facing area A (S37). Here, in a case in which a deformation of the paper P is due to absorbing of ink by the paper P, when this state is held for some time, the lifting off of the paper P is abated, and as a result, the paper P is separated from the nozzle surface 10*a*. Consequently, as described above, by waiting for the predetermined time before discharging the paper P from the facing area A, it is possible to suppress an occurrence of paper rubbing between the paper P and the nozzle 10*a* at the time of discharging the paper P.

Next, the CPU 101 once again generates the jetting data from the same image data such that an amount of ink jetted per paper P becomes smaller than that for the jetting data that was used in the previous print processing (step S38). For instance, the CPU 101, by changing the threshold value in the quantization processing, lowers a ratio (proportion) of jetting an ink of medium-size droplets and an ink of large-size droplets on one hand, and increases a ratio (proportion) of jetting an ink of small-size droplets. Thereafter, the process is shifted to step S5 in order to execute printing based on the jetting data that has been generated, on a new paper P. In such manner, by changing to the jetting data for which the amount of ink jetted per paper P is small, during the re-printing, it is possible to suppress an amount of deformation of the paper P due to the ink jetted from the nozzles 10. As a result of this, during the re-printing, it is possible to suppress the paper rubbing from occurring.

According to the present embodiment, in the case in which the detection position of the detection sensor 22 is the abnormal position, the judgment of paper rubbing is made by using the second threshold value corresponding to the velocity slower than the first threshold value which is used in the case in which the detection position is a position other than the abnormal position. In such manner, by using different threshold values for the abnormal position and the position other than the abnormal position, it is possible to make a judgement of paper rubbing with high accuracy even when the carriage velocity Vcr that has been acquired on the basis of the result of detection by the detection sensor 22 has dropped due to the dirt on the scale 21.

Moreover, since the movement of the carriage 4 from the stand-by position to the flushing position for the flushing processing carried out before the print processing is concurrent with the movement of the carriage 4 in the abnormal-position detection processing, it is not necessary to move the carriage 4 newly only for the abnormal-position detection processing.

Moreover, after the rimless printing and after the jamming, since there is a possibility of a dirt adhered newly to the scale 21, the abnormal-position detection processing is to be executed before carrying out the subsequent printing. As a result of this, in the subsequent printing, it is possible to make a judgment of paper rubbing with high accuracy. Although it is not depicted in flowchart diagrams in FIGS. 8A, 8B and FIG. 9, even in a case in which the CPU 101 has made a judgment that the jamming of paper has occurred, on the basis of the pulse signal of the rotary encoder 40 and the result of detection by the paper sensors 38 and 39, the abnormal-position detection processing is to be carried out before carrying out the subsequent printing.

In the embodiment described above, the carriage motor 16 corresponds to the 'carriage drive section'. The detection sensor 22 corresponds to the 'detection section', and the non-transmissive area 21*b* corresponds to the 'indicator'. The non-volatile memory 104 corresponds to the 'storage section'. The flushing receiver 9 corresponds to the 'liquid receiver'. The carriage velocity Vcr which is acquired on the basis of the result of detection by the detection sensor 22 corresponds to the velocity-parameter value. The velocity-drop rate corresponds to the 'velocity information'. The paper sensors 38 and 39, and the rotary encoder 40 correspond to the 'jamming detection section'.

Figure 10A:
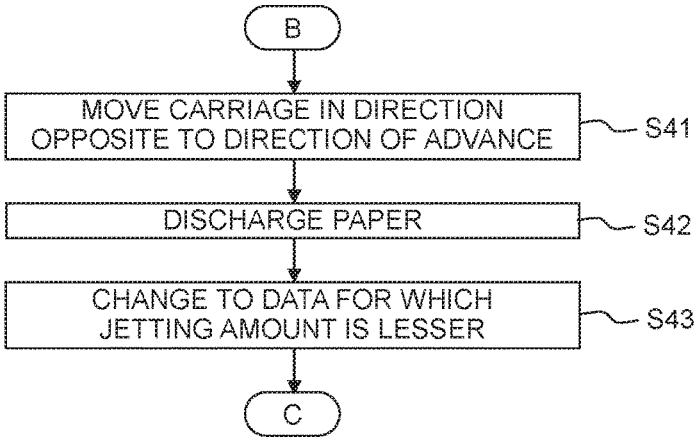
FIGS. 10A and 10B are flowcharts depicting an operation of an ink-jet printer according to a modified embodiment.
Figure 10B:
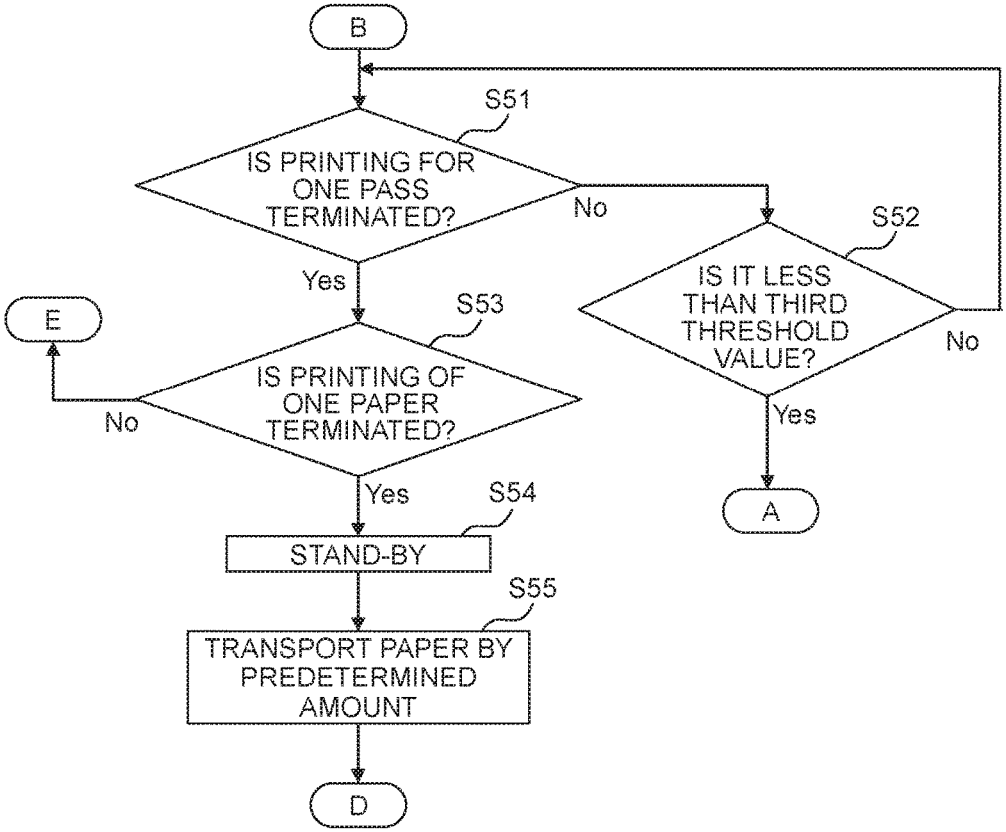

Preferred embodiment of the present teaching has been described above. However, the present teaching is not restricted to the abovementioned embodiment, and various modifications are possible without departing from the scope of the patent claim. For example, the processing after the CPU 101 has made a judgment that the paper rubbing has occurred (YES at step S10 and YES at step S11) may be let to be as depicted in FIG. 10A and FIG. 10B. These modified embodiments will be described below.

Firstly, a modified embodiment depicted in FIG. 10A will be described below. The CPU 101, in a case in which has made the judgment that the paper rubbing has occurred, moves the carriage 4 in a direction opposite to the direction of advance of the carriage 4 when the judgment of paper rubbing has been made, by controlling the carriage motor 16 till the carriage 4 is at an outer side of the platen 41 (step S41). Till the judgment of paper rubbing has been made, since the head 5 and the paper P do not make a contact, even when the carriage 4 is moved in the direction opposite to the direction of advance as in the processing at step S41, a possibility that the paper rubbing occurs between the head 5 and the paper P is low.

Thereafter, the CPU 101, after executing the processing at steps S42 and S43 similar to the abovementioned processing at steps S37 and S38, shifts the process to step S5 in order to execute printing on the basis of the jetting data that has been generated, on a new paper P. Even in the present modified embodiment, after the judgment of paper rubbing has been made, it is possible to suppress a damage caused to the head 5 due to paper rubbing.

Next, a modified embodiment depicted in FIG. 10B will be described below. In the present modified embodiment, the CPU 101, even having made the judgment that the paper rubbing has occurred, carries out the printing continuously as long as no jamming occurs, if the printing of that pass is not terminated. Specifically, in a case in which, a judgment has been made that the paper rubbing has occurred, the CPU 101 makes a judgment of whether or not the printing for one pass is terminated (step S51). In a case in which a judgment has been made that the printing for one pass is not terminated (NO at step S51), the CPU 101 continues printing, and makes a judgment of whether or not the carriage velocity Vcr that has been acquired is less than the third threshold value (step S52). In a case in which a judgment has been made that the carriage velocity Vcr is not less than the third threshold value (NO at step S52), the process returns to step S51. Whereas, in a case in which a judgment has been made that the carriage velocity Vcr is less than the third threshold value (YES at step S52), the CPU 101 makes a judgment that the jamming has occurred, and the process shifts to step S53.

In the processing at step S51, in a case in which a judgment is made that the printing for one pass is terminated (YES at step S51), the CPU 101 makes a judgment of whether or not printing on one paper P is terminated (step S53). In a case in which, a judgment has been made that the printing on one paper P is terminated (YES at step S53), the process shifts to step S15. Whereas, in a case in which a judgment has been made that the printing on one paper is not terminated (NO at step S53), the CPU 101 waits only for a predetermined time (step S54), and transports the paper P forward only by a predetermined amount by controlling the conveyance motor 37 (step S55). Thereafter, the process shifts to step S6 in order to execute printing of the subsequent pass. As described above, in the case in which a judgment is made that the paper rubbing has occurred, the printing of the subsequent pass is started after waiting for the predetermined time. In other words, when the judgment is made that the paper rubbing has occurred, print-start timing of the subsequent pass is delayed as compared to that in the case when the judgment that the paper rubbing has occurred is not made. Accordingly, at the print-start timing of the subsequent pass, since the lifting off of the paper P is abated by an amount (for the time) of the predetermined stand-by time, it is possible to reduce a possibility that the paper rubbing occurs at the time of printing of the subsequent pass. Moreover, even when a judgment is made that the paper rubbing has occurred, since the print processing is executed continuously, it is possible to shorten the time required for the print processing.

Next, another modified embodiment will be described below. As mentioned above, the control of the velocity of the carriage 4 is carried out by the feedback back control based on the deviation between the current carriage velocity Vcr acquired on the basis of the result of detection by the detection sensor 22 and the target velocity. Therefore, when the detection position of the detection sensor 22 is spread across the abnormal position, the CPU 101 erroneously makes a judgment that the velocity of the carriage 4 has dropped below the target velocity, and controls the carriage motor 16 such that the velocity of the carriage 4 rises. Consequently, the actual velocity of the carriage 4 becomes more than the target velocity. Thereafter, by the feedback control, the velocity of the carriage (carriage velocity Vcr acquired) is converged to the target velocity, and in that process, the velocity of the carriage 4 fluctuates to be higher and lower than the target velocity. Moreover, at this time, the higher the target velocity of the carriage 4 during the jetting processing, larger is a range of fluctuation in the velocity of the carriage 4. Consequently, in a case in which the target velocity is high, due to the fluctuation in the velocity of the carriage 4, sometimes the carriage velocity Vcr acquired on the basis of the result of detection by the detection sensor 22 may be less than the first threshold value. In other words, even when the detection position of the detection sensor 22 is a position other than the abnormal position, and is within a predetermined range in front and at rear of the abnormal position, sometimes the actual velocity of the carriage 4 (carriage velocity Vcr) is less than the first threshold value due to the dirt on the scale 21. Accordingly, regardless of whether or not the paper rubbing has occurred, there is a possibility that a judgment is made erroneously that the paper rubbing has occurred.

Therefore, in the present modified embodiment, when a velocity (second velocity) less than a predetermined velocity value from among the velocities of the plurality of stages that can be set, is set as the target velocity of the carriage 4 in the jetting processing, a rubbing-judging processing is to be carried out similarly as in the embodiment. Whereas, when a velocity (first velocity) less than the velocity threshold value is set as the target velocity of the carriage 4 in the jetting processing, the rubbing-judging processing is to be changed.

Figure 11A:
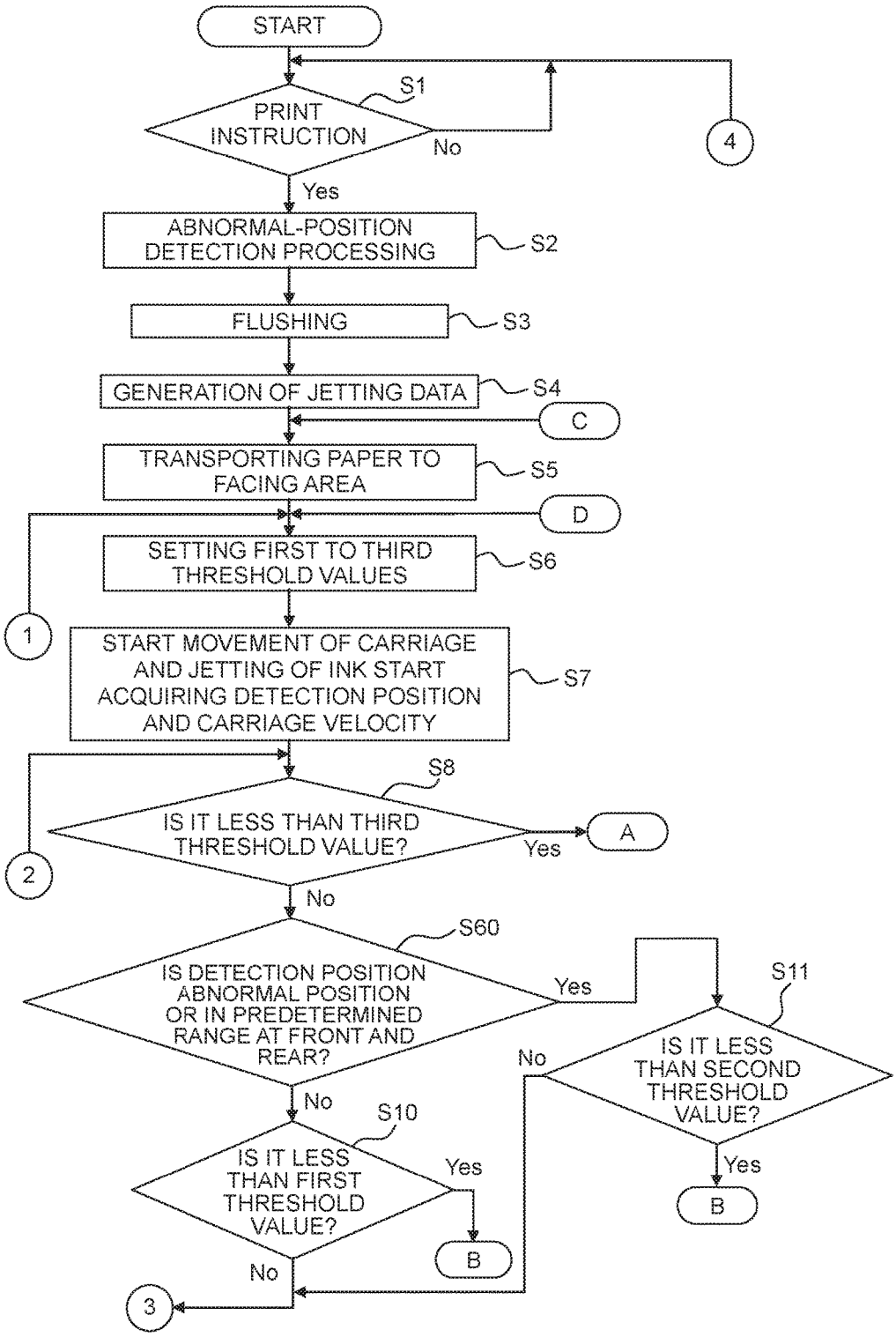
FIGS. 11A and 11B are flowcharts depicting an operation of an ink-jet printer according to a modified embodiment.
Figure 11B:
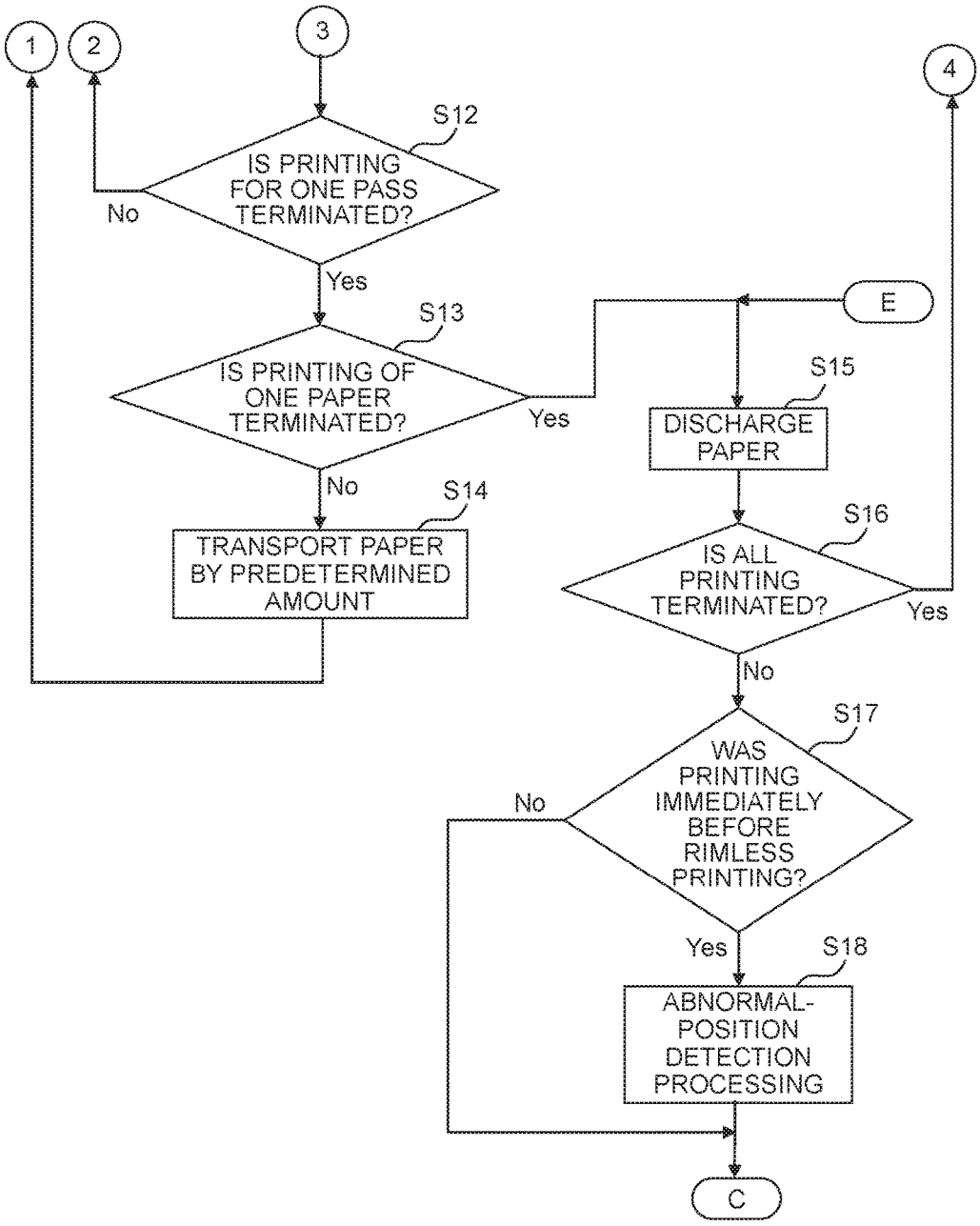

Specifically, even when the detection position of the detection sensor 22 is at a position other than the abnormal position in the abnormal-position information stored in the non-volatile memory 104, but is within the predetermined range in front and at rear of the abnormal position, in a case in which the carriage velocity Vcr acquired at that time is less than the second threshold value and not less than the third threshold value, the CPU 101 makes a judgment that the paper rubbing has occurred. In other words, in a case in which the carriage velocity Vcr that has been acquired is less than the first threshold value and greater than or equal to the second threshold value, the CPU 101 does not make a judgment that paper rubbing has occurred. More elaborately, in the operation of the printer 1, the CPU executes processing at step S60 instead of the abovementioned processing at step S9 as depicted in FIG. 11A. In the processing at step S60, the CPU 101 makes a judgment of whether or not the detection position of the detection sensor 22 is the abnormal position, or is within the predetermined range in front and at rear of the abnormal position. Moreover, in a case in which a judgment has been made that the detection position is a position other than the abnormal position, and is out of the predetermined range in front and at rear of the abnormal position (NO at step S60), the process shifts to step S10. Whereas, in a case in which, a judgment has been made that the detection position is the abnormal position, and is within the predetermined range in front and at rear of the abnormal position (YES at step S60), the process shifts to step S11.

As described above, it is possible to reduce a possibility of judging erroneously that paper rubbing has occurred by the fluctuation in velocity of the carriage 4 caused due to the dirt on the scale 21. Regardless of the target velocity of the carriage 4 during the jetting processing, when the detection position of the detection sensor 22 is within the predetermined range in front and at rear of the abnormal position, in a case in which the carriage velocity Vcr acquired at that time is less than the second threshold value and not less than the third threshold value, the CPU 101 may make a judgment that paper rubbing has occurred.

Other modified embodiments will be described below.

In the abovementioned embodiment, an arrangement was made such that the detection sensor 22 detects the non-transmissive area 21*b* of the encoder 7 as an indicator. However, an arrangement may be made such that the detection sensor 22 detects the transmissive area 21*a* as an indicator. Moreover, the encoder 7 was a so-called transmission-type linear encoder. However, without restricting to this, the encoder 7 may be a linear encoder of reflection type. In this case, the abovementioned non-transmissive area 21*b* is to be changed to a non-reflective area which does not reflect light, and the transmissive area 21*a* is to be changed to a reflective area which reflects light. Moreover, by arranging both the light-emitting element 26 and the light-receiving element 27 of the detection sensor 22 at a front side or a rear side of the scale 21, it is possible to output a pulse signal similar to that in the abovementioned embodiment, from the detection sensor 22. Furthermore, the encoder 7 may be an encoder of a type other than an optical type, and an encoder such as a magnetic encoder may be used. In this case, the abovementioned non-transmissive area 21*b* may be an area that is magnetized, and the transmissive area 21*b* may be let to be an area that is not magnetized.

Moreover, the target velocity of the carriage 4 in the abnormal-position detection processing is not required to be the maximum velocity that can be set, and may be other velocity that can be set. Moreover, the scale 21 may be divided in to a plurality of segmented areas, and in the abnormal-position detection processing, abnormal-position information may be generated by letting the segmented areas to be independent. For instance, each segmented area is to be divided to have a plurality of non-transmissive areas 21*b*. Moreover, in a case in which any of the carriage velocity Vcr acquired in this segmented area is lower than a predetermined threshold value, the overall segmented area may be let to be the abnormal position. In a case in which the dirt on the scale 21 is spread across two adjacent segmented areas, both these segmented areas as a whole may be let to be the abnormal position. As described above, by generating the abnormal-position information upon letting the segmented areas to be independent, it is possible to reduce a storage capacity at the time of storing the abnormal-position information in the non-volatile memory 104. Moreover, in the abnormal-position detection processing, the carriage 4 was moved through the range from the stand-by position up to the flushing position. However, the range of movement in the abnormal-position detection processing is not restricted to this in particular. Therefore, in the abnormal-position detection processing, out of the abnormal-position information that has been stored in the non-volatile memory, only abnormal-position information corresponding to the range of movement through which the carriage 4 was moved may be updated.

Moreover, the abnormal-position information may be information which included only the abnormal position. In this case, a uniform value corresponding to the target velocity is to be set as the second threshold value, instead of setting the threshold value for each abnormal position. Moreover, the velocity information which is included in the abnormal-position information is not required to be the velocity-drop rate, and may be the carriage velocity Vcr corresponding to the abnormal position.

In the abovementioned embodiment, the carriage velocity Vcr was acquired on the basis of the result of detection by the detection sensor 22. However, a velocity-parameter value related to the carriage velocity Vcr may be acquired and not the carriage velocity Vcr. For instance, instead of calculating the carriage velocity Vcr, the clock number CK acquired during the V1 holding period may be acquired as the velocity-parameter value. In this case, the slower the velocity of the carriage 4, higher is the velocity-parameter value. Consequently, of the values from first threshold value to the third threshold value, the first threshold value becomes the smallest value and the third threshold value becomes the largest value.

Moreover, in the abovementioned embodiment, in a case in which a judgment is made that the paper rubbing has occurred, by changing the jetting data, the amount of ink to be jetted per paper P at the time of reprinting was reduced. However, an arrangement is not restricted to this. For example, the amount of ink to be jetted may be reduced by adjusting a drive voltage to the drive elements in the actuator of the head 5.

Moreover, in the abovementioned embodiment, a judgment of whether or not the paper P is positioned at the facing area A was made on the basis of the result of detection by the paper sensor 38. However, without restricting to this, a sensor which is capable of directly detecting whether or not the paper P is positioned at the facing area A may be provided, and a judgment of whether or not the paper P is positioned at the facing area may be made on the basis of a result of detection by this sensor.

Moreover, in the abovementioned embodiment, the first threshold value was set to a value which is 90% of the target velocity. However, the first threshold value is not restricted to be set to the abovementioned value. For example, the CPU 101, when has executed the abnormal-position detection processing, detects the carriage velocity Vcr which is the lowest of the carriage velocities at the plurality of positions judged to be positions other than the abnormal position. Moreover, the CPU 101 may set the first threshold value to be a value which is 90% of the lowest carriage velocity Vcr.

The carriage velocity Vcr fluctuates slightly due to the carriage 4 making a contact with a small foreign matter etc. on the guide rails 11 and 12. The CPU 101 sets the first threshold value with the lowest carriage velocity Vcr as a reference in order to not judge erroneously that the paper rubbing has occurred, due to such fluctuation in the carriage velocity Vcr. Accordingly, it is possible to prevent the CPU 101 from making an erroneous judgment of paper rubbing. The lowest carriage velocity is slower than the target velocity.

What is claimed is:

1. An ink-jet printer, comprising:

a carriage configured to move in a scanning direction;

a head including a nozzle, the head mounted on the carriage;

an encoder including:

a scale extending in the scanning direction and including a plurality of indicators formed at a predetermined interval in the scanning direction; and a sensor mounted on the carriage, the sensor being configured to detect the indicators formed on the scale;

a memory; and a controller configured to perform:

judging whether a recording medium is positioned at a facing area being capable of facing the carriage;

detecting an abnormal position on the scale in the scanning direction, under a condition that the controller judges that the recording medium is not positioned at the facing area, wherein detecting the abnormal position includes: moving the carriage in the scanning direction; generating abnormal-position information indicating the abnormal position on the scale, based on a result of detecting the indicators by the sensor during a movement of the carriage; and storing the abnormal-position information in the memory;

printing an image on the recording medium, under a condition that the controller judges that the recording medium is positioned at the facing area, wherein printing the image includes: controlling a velocity of the carriage based on a velocity parameter value of the carriage acquired from the result of detecting the indicators by the sensor, such that the carriage moves in the scanning direction at a first target velocity; and controlling the head to discharge a liquid from the nozzle toward the recording medium based on image data;

under a condition that the controller performs printing the image and that a detection position on the scale detected by the sensor is not same as the abnormal position in the abnormal-position information stored in the memory, comparing a velocity parameter value acquired when the sensor detects the detection position on the scale and a first threshold value corresponding to a velocity lower than the first target velocity at the time of printing the image; and under a condition that the controller performs printing the image and that a detection position on the scale detected by the sensor is same as the abnormal position in the abnormal-position information stored in the memory, comparing a velocity parameter value acquired when the sensor detects the detection position on the scale and a second threshold value corresponding to a velocity lower than the first threshold value.

2. The ink-jet printer according to claim 1, wherein the controller is configured to perform:

judging that rubbing has occurred between the head and the recording medium, under a condition that the acquired velocity parameter value is lower than the first threshold value; and judging that rubbing has occurred between the head and the recording medium, under a condition that the acquired velocity parameter value is lower than the second threshold value.

3. The ink-jet printer according to claim 2, wherein under a condition that the controller judges that the rubbing has occurred between the head and the recording medium, the controller is configured to stop moving the carriage.

4. The ink jet printer according to claim 2, wherein under a condition that the controller judges that the rubbing has occurred between the head and the recording medium, the controller is configured to move the carriage in an opposite direction opposite to a traveling direction of the carriage, the traveling direction being a direction which is parallel to the scanning direction and in which the carriage moves when the controller judges that the rubbing has occurred between the head and the recording medium.

5. The ink-jet printer according to claim 2, wherein the controller is configured to perform a pass printing multiple times, and during performing the pass printing, the controller is configured to move the carriage in the scanning direction and control the head to discharge from the nozzle, and wherein under a condition that the controller judges that the rubbing has occurred between the head and the recording medium during a predetermined pass printing, the controller is configured to continue to execute the predetermined pass printing, and delay starting of printing for a subsequent pass after the predetermined pass printing as compared to a case that the controller judges that no rubbing has occurred between the head and the recording medium.

6. The ink-jet printer according to claim 2, wherein at a time of printing the image, the controller is configured to judge that rubbing has occurred between the head and the recording medium, under a condition that the position on the scale detected by the sensor is not same as the abnormal position in the abnormal-position information stored in the memory and is within a predetermined range from the abnormal position, and under a condition that a velocity corresponding to the velocity parameter value acquired at a time of detecting the position on the scale is lower than the second threshold value.

7. The ink-jet printer according to claim 2, wherein the controller is configured to set a first velocity and a second velocity, the second velocity being slower than the first velocity, as a second target velocity at a time of moving the carriage in the scanning direction at a constant velocity, and wherein at a time of printing the image, the controller is configured to set one of the first velocity and the second velocity as the second target velocity, and move the carriage in the scanning direction at a constant velocity, and wherein in a case that the second target velocity of the carriage set at a time of printing the image is the first velocity, the controller is configured to judge that the rubbing has occurred between the head and the recording medium, under a condition that the position on the scale detected by the sensor is not same as the abnormal position in the abnormal-position information stored in the memory, and is within a predetermined range from the abnormal position, and under a condition that a velocity corresponding to the velocity parameter value acquired at a time of detecting the position on the scale by the sensor is lower than the second threshold value.

8. The ink-jet printer according to claim 2, wherein under a condition that the controller judges that the rubbing has occurred between the head and the recording medium during the printing, the controller is configured to stop printing and thereafter, newly perform printing based on image data same as that for the printing stopped, upon reducing an amount of liquid discharged from the nozzle per one recording medium.

9. The ink jet printer according to claim 1, wherein at a time of detecting the abnormal position, the controller is configured to acquire the velocity-parameter value corresponding to the abnormal position based on the detection of the indicators by the sensor, and generate the abnormal-position information including the abnormal position and velocity information related to the velocity-parameter value corresponding to the abnormal position, and the controller is configured to set the second threshold value for the abnormal position, based on the velocity information corresponding to the abnormal position in the abnormal-position information stored in the memory.

10. The ink-jet printer according to claim 1, wherein at a time of detecting the abnormal position, the controller is configured to move the carriage in the scanning direction at a constant velocity, and generate the abnormal-position information based on the detection of the indicators by the sensor upon moving the carriage.

11. The ink-jet printer according to claim 1, wherein at a time of moving the carriage in the scanning direction at a constant velocity, the controller is configured to set a plurality of target velocities, and wherein at a time of detecting the abnormal position, the controller is configured to set the highest target velocity among the plurality of target velocities to move the carriage in the scanning direction at a constant velocity corresponding to the highest target velocity.

12. The ink-jet printer according to claim 1, wherein at a time of moving the carriage in the scanning direction at a constant velocity, the controller is configured to set a plurality of target velocities, and wherein at a time of printing the image, the controller is configured to set one of the plurality of target velocities to move the carriage in the scanning direction at a constant velocity corresponding to the one of the target velocities, and set the first threshold value and the second threshold value based on the one of the target velocities of the carriage.

13. The ink-jet printer according to claim 1, further comprising:

a platen being capable of facing the carriage, the platen being configured to support the recording medium;

a cap positioned at an outer side of the platen in the scanning direction, the cap being configured to cover the nozzle of the head; and a liquid receiver positioned at an opposite side of the cap, with respect to the platen in the scanning direction, wherein under a condition that the carriage is positioned at a flushing position where the head discharges the liquid toward the liquid receiver from the nozzle, the controller is configured to control the head to perform flushing in which the liquid is discharged from the nozzle toward the liquid receiver, and wherein under a condition that the carriage is positioned at a stand-by position where the carriage faces the cap, and that the controller has received a print execution command, before printing, the controller is configured to move the carriage from the stand-by position to the flushing position, and perform detecting the abnormal position, and control the head to perform flushing after the carriage is positioned at the flushing position at a time of detecting the abnormal position.

14. The ink-jet printer according to claim 1, wherein under a condition that the head has discharged the liquid over a range wider than a length of a recording medium in the scanning direction, the controller is configured to perform detecting the abnormal position before the printing subsequently.

15. The ink-jet printer according to claim 1, further comprising:

a second sensor configured to detect jamming, wherein under a condition that the controller judges that jamming has occurred based on a detection result of the second sensor, the controller is configured to perform detecting the abnormal position before the printing subsequently.

16. The ink-jet printer according to claim 1, wherein upon detecting the abnormal position, the controller is configured to divide an area of the scale into a plurality of split areas each having a plurality of indicators, and generate the abnormal-position information for each of the split areas of the scale.

17. The ink-jet printer according to claim 1, wherein the controller is configured to judge that jamming has occurred, under a condition that the velocity parameter value acquired by a result of detecting the indicator of the sensor is lower as compared to a third threshold value being lower than the second threshold value.

18. The ink jet printer according to claim 1, wherein the first threshold value is 90% of the first target velocity.

19. The ink-jet printer according to claim 1, wherein at a time of detecting the abnormal position, the controller is configured to acquire a velocity of the carriage at each of a plurality of positions being not the abnormal position, and set 90% of the lowest of the plurality velocities acquired of the carriage, as the first target velocity.

* * * * *